US007028779B2

(12) United States Patent
Chau

(10) Patent No.: US 7,028,779 B2
(45) **Date of Patent: *Apr. 18, 2006**

(54) AUTO-EXTENDING/RETRACTING ELECTRICALLY ISOLATED CONDUCTORS IN A SEGMENTED DRILL STRING

(75) Inventor: Albert W. Chau, Woodinville, WA (US)

(73) Assignee: Merlin Technology, Inc., Renton, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/014,430

(22) Filed: Dec. 16, 2004

(65) Prior Publication Data

US 2005/0098356 A1 May 12, 2005

Related U.S. Application Data

(63) Continuation of application No. 10/313,303, filed on Dec. 6, 2002, now Pat. No. 6,845,822, which is a continuation-in-part of application No. 09/954,573, filed on Sep. 10, 2001, now Pat. No. 6,655,464, which is a continuation-in-part of application No. 09/793,056, filed on Feb. 26, 2001, now Pat. No. 6,446,728, which is a continuation of application No. 09/317,308, filed on May 24, 1999, now Pat. No. 6,223,826.

(51) Int. Cl.
*E21B 19/16* (2006.01)

(52) U.S. Cl. ..... 166/380; 166/65.1; 175/320

(58) Field of Classification Search ..... 166/380, 166/65.1; 175/320; 439/557, 578
See application file for complete search history.

(56) References Cited

U.S. PATENT DOCUMENTS

| | | | | |
|---|---|---|---|---|
| 4,690,212 | A | 9/1987 | Termohlen | |
| 4,902,246 | A | 2/1990 | Samchisen | |
| 5,002,503 | A | 3/1991 | Campbell et al. | |
| 5,131,464 | A | 7/1992 | Lenhart et al. | |
| 5,141,051 | A | 8/1992 | Lenhart | |
| 5,155,442 | A | 10/1992 | Mercer | |
| 5,337,002 | A | 8/1994 | Mercer | |
| 5,366,018 | A | 11/1994 | Van Steenwyk et al. | |
| 5,444,382 | A | 8/1995 | Mercer | |
| 5,633,589 | A | 5/1997 | Mercer | |
| 5,667,009 | A | 9/1997 | Moore | |
| 5,993,253 | A | 11/1999 | Sai | |
| 6,050,353 | A | 4/2000 | Logan et al. | |
| 6,223,826 | B1 | 5/2001 | Chau et al. | |
| 6,257,332 | B1 | 7/2001 | Vidrine et al. | |
| 6,402,524 | B1 | 6/2002 | Wurm et al. | |
| 6,446,728 | B1 | 9/2002 | Chau et al. | |
| 6,655,464 | B1 | 12/2003 | Chau et al. | |
| 6,845,822 | B1 * | 1/2005 | Chau | 166/380 |

* cited by examiner

*Primary Examiner*—William Neuder
(74) *Attorney, Agent, or Firm*—Michael Pritzkau

(57) ABSTRACT

A system includes a drill string made up of a plurality of connectable pipe sections. An assembly is provided for use with each pipe section including contact arrangement for forming an isolated electrical connection between attached pipe sections at each end of each pipe section. An electrically conductive arrangement is located in the innermost passage of each pipe section and is in electrical communication with the contact arrangement to extend therebetween in a way which provides an electrically conductive path that is arranged against the inner wall of the innermost passage of each pipe section in cooperation with the contact arrangement to form an overall electrically isolated conductive path through the drill string. The electrically conductive arrangement resiliently biases the electrically conductive path against the inner wall, which path may take the form of a helix.

18 Claims, 22 Drawing Sheets

AUTO-EXTENDING/RETRACTING ELECTRICALLY ISOLATED CONDUCTORS IN A SEGMENTED DRILL STRING

RELATED APPLICATIONS

The present application is a Continuation of U.S. application Ser. No. 10/313,303 filed Dec. 6, 2002 now U.S. Pat. No. 6,845,822, which is a Continuation-In-Part of U.S. application Ser. No. 09/954,573 filed Sep. 10, 2001 and issued as U.S. Pat. No. 6,655,464 on Dec. 2, 2003 which is a Continuation-In-Part of U.S. application Ser. No. 09/793,056 filed Feb. 26, 2001 and issued as U.S. Pat. No. 6,446,728 on Sep. 10, 2002, which is a Continuation of U.S. application Ser. No. 09/317,08 filed May 24, 1999 and issued as U.S. Pat. No. 6,223,826 on May 1, 2001, all of which are incorporated herein by reference.

BACKGROUND OF THE INVENTION

The present invention relates generally to underground directional boring, underground resource extraction and more particularly, to automatically extending and retracting electrically isolated conductors provided in a segmented drill string. An associated method is also disclosed.

Guided horizontal directional drilling techniques are employed for a number of purposes including, for example, the trenchless installation of underground utilities such as electric and telephone cables and water and gas lines. As a further enhancement, state of the art directional drilling systems include configurations which permit location and tracking of an underground boring tool during a directional drilling operation. As will be seen, the effectiveness of such configurations can be improved by providing an electrical pathway between a drill rig which operates the boring tool and the boring tool itself.

Turning to FIG. 1, a horizontal boring operation is illustrated being performed using a boring/drilling system generally indicated by the reference numeral 10. The drilling operation is performed in a region of ground 12 including an existing underground utility 14. The surface of the ground is indicated by reference number 16.

System 10 includes a drill rig 18 having a carriage 20 received for movement along the length of an opposing pair of rails 22 which are, in turn, mounted on a frame 24. A conventional arrangement (not shown) is provided for moving carriage 20 along rails 22. During drilling, carriage 20 pushes a drill string 26 into the ground and, further, is configured for rotating the drill string while pushing. The drill string is made up of a series of individual drill string or pipe sections 28, each of which includes any suitable length such as, for example, ten feet. Therefore, during drilling, pipe sections must be added to the drill string as it is extended or removed from the drill string as it is retracted. In this regard, drill rig 18 may be configured for automatically or semi-automatically adding or removing the drill string sections as needed during the drilling operation. Underground bending of the drill string enables steering, but has been exaggerated for illustrative purposes.

Still referring to FIG. 1, a boring tool 30 includes an asymmetric face 32 and is attached to the end of drill string 36. Steering of the boring tool is accomplished by orienting face 32 of the boring tool (using the drill string) such that the boring tool is deflected in the desired direction. Boring tool 30 includes a mono-axial antenna such as a dipole antenna 44 which is driven by a transmitter 46 so that a magnetic locating signal 48 is emanated from antenna 44. In one embodiment, power may be supplied to transmitter 46 from a set of batteries 50 via a power supply 52. In another embodiment (not shown), to be described in further detail below, an insulated electrical conductor is installed within the drill string between the drill rig and the boring tool in order to carry power to transmitter 46. A control console 54 is provided at the drill rig for use in controlling and/or monitoring the drilling operation. The control console includes a display screen 56, an input device such as a keyboard 58 and a plurality of control levers 60 which, for example, hydraulically control movement of carriage 20 along with other relevant functions of drill rig operation.

Drill pipe 28 defines a through passage (not shown) for a number of reasons, including considerations of design, manufacturing methods, strength, and weight, but also because typical horizontal directional drilling also requires the use of some type of drilling fluid (not shown), most commonly a suspension of the mineral bentonite in water (commonly referred to as "drilling mud"). Drilling mud, which is generally alkaline, is emitted under pressure through orifices (not shown) in boring tool 30 after being pumped through the innermost passage of drill pipes 28 which make up drill string 26. Drilling mud is typically pumped using a mud pump and associated equipment (none of which are shown) that is located on or near drill rig 18. The pressures at which the drilling mud is pumped can vary widely, with a commonly encountered range of operation being 100 PSI to 4,000 PSI, depending on the design and size of the particular drill rig. For proper operation, pipe connections between drill pipe sections 28 must not only be sufficiently strong to join the sections against various thrust, pull and torque forces to which the drill string is subjected, but they must also form a seal so as to not allow the escape of drilling mud from these connections which could result in an unacceptable drop in drilling mud pressure at the orifices of the boring tool.

Continuing to refer to FIG. 1, drilling system 10 may include a portable locator/controller 70 held by an operator 72 for sensing locating signal 48 in a way which allows the underground position of boring tool 30 to be identified. Such portable detectors are described, for example, in U.S. Pat. Nos. 5,155,442, 5,337,002, 5,444,382 and 5,633,589 as issued to Mercer et al, all of which are incorporated herein by reference. Alternatively, one or more detectors (not shown) designed for positioning at fixed, above ground locations may be used, as described in U.S. patent application Ser. No. 08/835,834, filing date Apr. 16, 1997, which is commonly assigned with the present application and is incorporated herein by reference.

Guided horizontal directional drilling equipment is typically employed in circumstances where the inaccuracies and lack of steering capability of non-guided drilling equipment would be problematic. A typical example is the situation illustrated in FIG. 1 in which the intended drill path requires steering the boring tool around, in this instance beneath, obstacles such as utility 14. Guided drilling is also important where the intended path is curved (not shown) or the target destination is more than a short distance (typically over 50 feet) from the starting point. In the latter situation, simply aiming a non-guided boring tool at the target destination from the starting point will seldom result in maintaining a sufficiently accurate drill path and/or arriving reasonably close to the target destination.

While system 10 of FIG. 1 illustrates a "walk-over" type locating system using a steerable boring tool, it should be appreciated that "non-walkover" guidance/locating systems (not shown) are also useful in conjunction with steerable boring tools. The less commonly used non-walkover systems typically utilize an instrumentation/sensor package (not shown) located in the boring tool that is electrically connected directly to console 54 at the drill rig via the aforementioned insulated electrical conductor (not shown) located inside the through passage of the drill string. While batteries 50 may be used in the boring tool to power the instrumentation/sensor package, the insulated conductor may be used to supply electrical power to the instrumentation/sensor package, thus eliminating batteries 50 for reasons which will be seen. At the same time, data may be transmitted from the instrumentation/sensor package to console 54 on the insulated conductor. Data can also be sent to the instrumentation/sensor package for calibration, signal processing and programming.

In the instance of both walkover and non-walkover systems, the objective is to use information obtained from the locating system as a basis for making corrections and adjustments to the direction of steerable boring tool 30 in order to drill a bore hole that follows an intended drill path. Therefore, in most drilling scenarios, a walkover system is particularly advantageous since the origin of the locating signal leads directly to the position of the boring tool. Typically, the locating signal, in a walkover system, is also used to transmit to above ground locations encoded information including the roll and pitch orientation of boring tool 30 along with temperature and battery voltage readings. Battery powered transmitters often employ one to four replaceable internal "dry-cell" type batteries as a source for electric power.

Although internal battery powered transmitters perform satisfactorily under many conditions, there are a number of limitations associated with their use, most of which are due to the relatively low electric power available from dry-cell batteries. For example, battery life for a self-powered transmitter is relatively short and, under some circumstances, the exhaustion of batteries can result in the need to withdraw an entire drill string for the purpose of replacing batteries in order to complete a drill run. It should also be appreciated that the low power level available from dry-cell batteries, from a practical standpoint, limits the signal strength of locating signal 48. The available signal strength is of concern in relation to the depth at which the boring tool may be tracked. That is, the above ground signal strength of locating signal 48 decays relatively rapidly as depth increases. The maximum operating depth for reliable receipt of locating signal 48 using a dry-cell powered transmitter 46 is limited to approximately 100 feet, depending on the particular design and characteristics of boring tool transmitter 46 and the above ground detector(s) used. This distance may decrease in the presence of passive and active forms of magnetic field interference, such as metallic objects and stray magnetic signals from other sources.

As a result of these limitations, drill head transmitters for walkover systems have been developed that can be powered by an above ground external power source via the aforementioned electrical conductor. That is, the typical electrical conductor for this external power source is similar to that used with non-walkover systems, namely a single insulated wire that connects to the transmitter with the ground return for the electrical circuit including the metallic housing of boring tool 30, drill pipe 28 making up the drill string, and drill rig 18. Even in the case where a locating signal is transmitted from the boring tool, the electric conductor may be used to send information from boring tool 30 to the drill rig including, for example, the roll and pitch orientation of the boring tool, temperature and voltage, using a variety of data encoding and transmission methods. By using the insulated electrical conductor, reliable operational depth may be increased by increasing the output power of transmitter 46 without concern over depletion of internal battery power. Moreover, information encoded on the electrical conductor can be received at the drill rig essentially irrespective of the operating depth of the boring tool and background noise level.

The prior art practice (not shown) for using externally-powered electronic and electrical devices located in the boring tool has been to insert a piece of insulated electrical conducting wire of appropriate length inside each piece of drill pipe 28 and manually perform a physical splice of the electrical wire to the wire in the prior section of drill pipe 28 each time an additional drill pipe section is added to the drill string. The process typically entails the use of specialized and relatively expensive crimp-on connectors and various types of heat-shrinkable tubing or adhesive wrappings that are mechanically secure, waterproof, and resistant to the chemical and physical properties of drilling mud. The process of interrupting pipe joining operations to manually splice the electrical conductor is labor-intensive and results in significant reductions in drilling productivity. Care must also be taken by the person performing splicing to avoid twisting or pinching the electrical wire, and any failure to properly splice can result in wire breakage and the need to withdraw the drill string to make repairs. For drill rigs having the capability of adding/removing drill pipe automatically or semi-automatically, this otherwise useful time and labor saving function must be disabled or interrupted to allow a manual splice of the electric wire. After completing the drill run, a reverse process of withdrawing the drill string and removing each section of drill pipe 28 from the ground requires cutting the wire each time a section of drill pipe is removed, resulting in considerable waste due to the discard of these once-used electrical wires and splicing materials.

Electrical conductors have been described by the prior art for use in applications other than horizontal directional drilling. One specific field of application resides in extraction of underground resources such as, for example, oil and natural gas. The need for an electrical communication path arises, in many instances, for the purpose of monitoring, controlling and/or providing operational power to in-ground devices such as valves and data acquisition modules. One such approach is exemplified by U.S. Pat. No. 6,257,332 entitled WELL MANAGEMENT SYSTEM (hereinafter the '332 patent). The problem being solved may be different, in some instances, than that encountered with respect to HDD, however, since HDD drill strings generally rotate. The objective, in the instance of a pre-existing wellbore such as an oil or gas well, may be to install an electrical cable in a pre-existing wellbore. Thus, a drill string type arrangement may simply be dropped or pushed into the pre-existing wellbore without the need for rotation or actual drilling. In this regard, the '332 patent and its related background art contemplates simply attaching an electrical cable to the exterior of the drill string as it is extended into the wellbore or, alternatively, threading the cable through the interior passage of the drill string. This latter approach is quite inconvenient unless a continuous (i.e. non-sectioned) pipe is used to house the cable since a cable splice must generally be performed whenever additional pipe is added to the drill string. Where the cable is attached to the exterior of the drill string, it is so exposed as to quite readily be damaged in any number of situations. As one example, the cable may be crushed between the drill string and the casing of the wellbore. As another example, the need even for limited rotation of the drill string such as for the purpose of steering could cause the cable to detach from the drill string. It should be appreciated that either type of cable installation is primarily possible due to the general non-rotation of the drill string.

The present invention provides a heretofore unseen and highly advantageous arrangement and associated method which automatically forms an isolated electrically conductive pathway between a drill rig and boring tool or other in-ground device as the drill string extending between the drill rig and the boring tool is either extended or shortened.

SUMMARY OF THE INVENTION

As will be described in more detail hereinafter, there are disclosed herein arrangements and an associated method of providing an isolated electrically conductive path in a system in which a boring tool is moved through the ground in a region. The system includes a drill rig and a drill string which is connected between a boring tool, or other in-ground device, and the drill rig and is configured for extension and/or retraction from the drill rig such that, when the drill string is extended, the boring tool moves in a forward direction through the ground and, when the drill string is retracted, the boring tool moves in a reverse direction approaching the drill rig. The drill string is made up of a plurality of electrically conductive drill pipe sections, each of which includes a section length and all of which are configured for removable attachment with one another to facilitate the extension and retraction of the drill string by one section length at a time. The improvement comprises an arrangement associated with each drill pipe section for providing part of at least one electrically conductive path along the section length of each drill pipe section, which electrically conductive path is electrically isolated from its associated drill pipe section and extends from the boring tool to the drill rig such that the electrically conductive path is extended by the section length when the drill string is extended by attachment of an additional drill pipe section to the drill string at the drill rig and the electrically conductive path is shortened by the section length when the drill string is shortened by detaching the additional drill pipe section from the drill string at the drill rig.

In one aspect of the present invention, a system is disclosed including a drill string for underground use. The drill string includes a length which is extendable and/or retractable through being made up of a plurality of pipe sections having opposing first and second ends and a section length defining an innermost passage and all of which pipe sections are configured for removable attachment with one another by physically connecting the first end of one pipe section with the second end of another pipe section to facilitate extension of the drill string by one section length at a time in a way which aligns the interior passage of attached ones of the pipe sections. As a portion of the system, an assembly is provided for use with each of the pipe sections including a pair of adapters for installation of a first one of the adapters in a first end of the innermost passage of each one of the pipe sections and installation of a second one of the adapters in a second end of the innermost passage of each one of the pipe sections. The first adapter defines a first electrical contact area and the second adapter defines a second electrical contact area. The first and second adapters are configured for resiliently biasing the first and second contact areas against one another between attached ones of the pipe sections to establish an electrical connection between the pair of adapters. An electrically conductive arrangement is located in the innermost passage of each pipe section and extends between and electrically connects each one of the pair of adapters so as to provide an electrically conductive path interconnecting the pair of adapters of each pipe section in electrical isolation from the pipe sections and cooperating with the adapters to form an electrically isolated path through the drill string.

In another aspect of the present invention, the first one of the pair of adapters is configured to resiliently bias the first electrical contact area against the second electrical contact area defined by the second adapter to provide electrical contact between the first and second electrical contact areas while adjacent ones of the pipe sections are attached to one another.

In still another aspect of the present invention, the first adapter includes a first electrically conductive member having a resilient section including a free end defining the first electrical contact area and having an opposing end configured for electrical communication with the electrically conductive arrangement. The free end is configured for engaging the second adapter in a way which brings the first and second electrical contact areas into electrical contact as adjacent ones of the pipe sections are attached to one another and, thereafter, resiliently biases the first electrical contact area against the second electrical contact area. In one feature, the first adapter is configured to apply a resilient bias in a direction generally along the length of the drill string between attached ones of the pipe sections to bias the first electrical contact area against the second electrical contact area. In another feature, the first adapter includes a first electrically conductive member having a resilient section including a free end defining the first electrical contact area and having an opposing, first connection end for electrical connection to the electrically conductive arrangement with a first conductive length defined between the first connection end and the resilient section. The first connection end is supported within the innermost passage of its associated pipe section with the resilient section extending outwardly from the innermost passage. In still another feature, the first conductive member is integrally formed using a resiliently flexible electrically conductive material. In yet another feature, the resilient section is in the form of a helical compression spring defining an axis generally oriented along the axis of the drill string. In a further feature, the first electrical contact surface is defined on the free end of the first conductive member facing away or outwardly from each pipe section in which the first adapter is installed.

In a further aspect of the present invention, the first and second adapters, along with the electrically conductive arrangement, may be installed in pipe sections in conjunction with the manufacturing process of the pipe sections. Alternatively, the first and second adapters may be provided as an after market kit for use with pipe sections already in field use.

In a continuing aspect of the present invention, one or more drill strings configured in accordance with the present invention so as to define an electrically isolated conductive path may be used as part of an electrical communication and/or power supply arrangement installed, for example, in a well in a way which forms a multiplexed data and power supply network. Such drill strings may be used, for instance, in horizontal directional drilling or in underground resource extraction.

In another aspect of the present invention, a system includes a drill string having a length which is configured for extension and/or retraction. The drill string is made up of a plurality of pipe sections having opposing first and second ends and a section length having an inner wall defining an innermost passage and all of which pipe sections are configured for removable attachment with one another by physically connecting the first end of one pipe section with the second end of another pipe section to facilitate extension of the drill string by one section length at a time. An assembly and associated method are provided for use with each one of the pipe sections including contact means for forming an isolated electrical connection between attached ones of the pipe sections that is located within the innermost passage at each opposing end of each pipe section. The assembly further includes an electrically conductive arrangement located in the innermost passage of each pipe section and in electrical communication with the contact means at each opposing end each pipe section to extend therebetween in a way which provides an electrically conductive path that is arranged against the inner wall of the innermost passage of each pipe section. The electrically conductive path cooperates with the contact means to form an overall electrically isolated conductive path through the drill string. In one feature, the electrically conductive arrangement resiliently biases the electrically conductive path against the inner wall. In another feature, the electrically conductive path at least generally forms a helix that is biased against the inner wall. The helix includes opposing helix ends that are electrically attached to the contact means at opposing ends of each pipe section. In still another feature, the electrically conductive path includes a coil spring having a coiled length that is extended along the innermost passage of each pipe section and having opposing spring ends that are electrically attached to the contact means at the opposing ends of each pipe section and the coiled length is configured to resiliently bias against the inner wall of the innermost passage. In yet another feature, the coil spring is a helical coil spring.

BRIEF DESCRIPTION OF THE DRAWINGS

The present invention may be understood by reference to the following detailed description taken in conjunction with the drawings briefly described below.

DETAILED DESCRIPTION OF THE INVENTION

Figure 1:
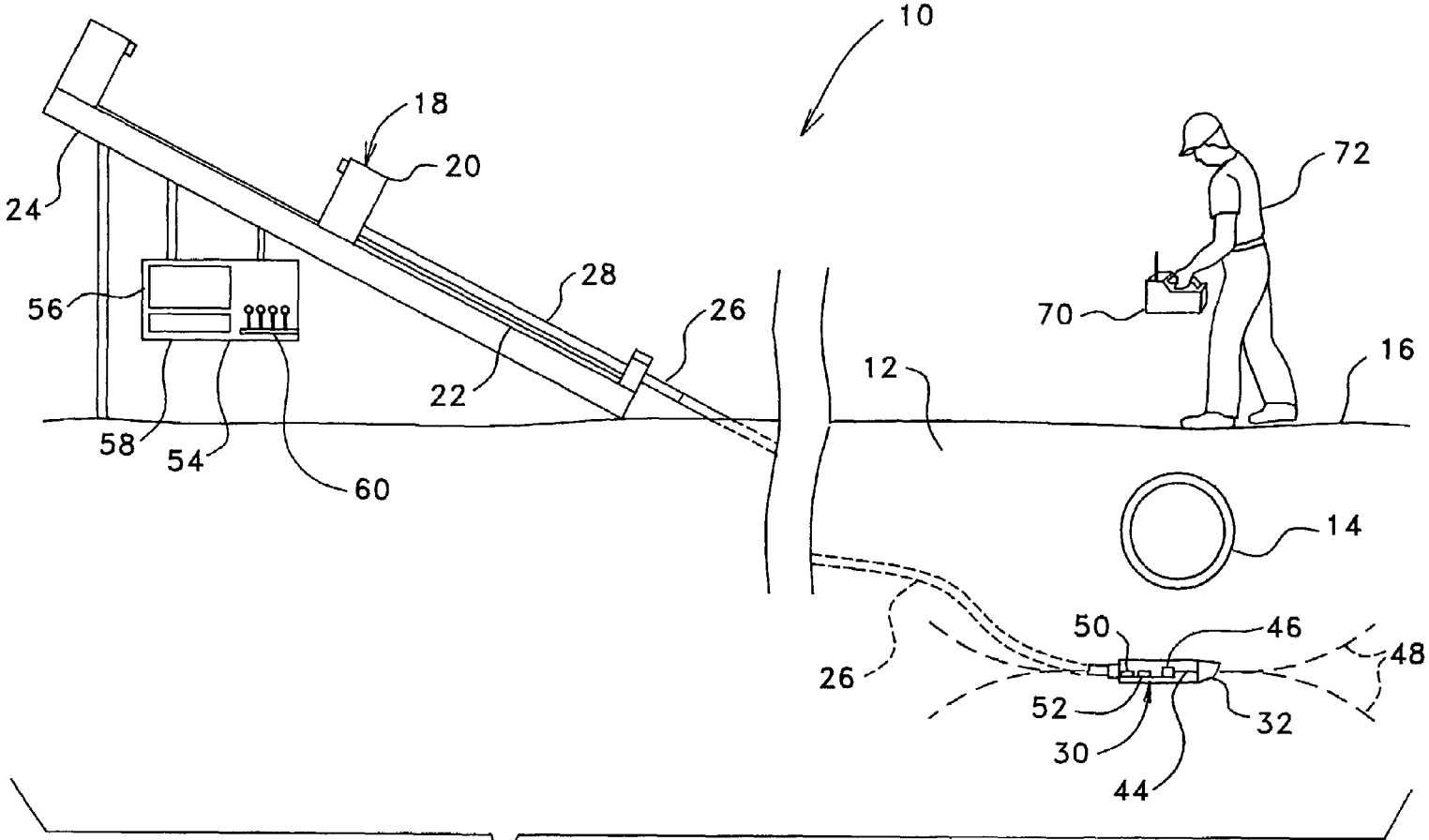
FIG. 1 (PRIOR ART)
FIG. 1 is a diagrammatic elevational view of a drilling operation being performed in a region in accordance with the prior art.
Figure 2:
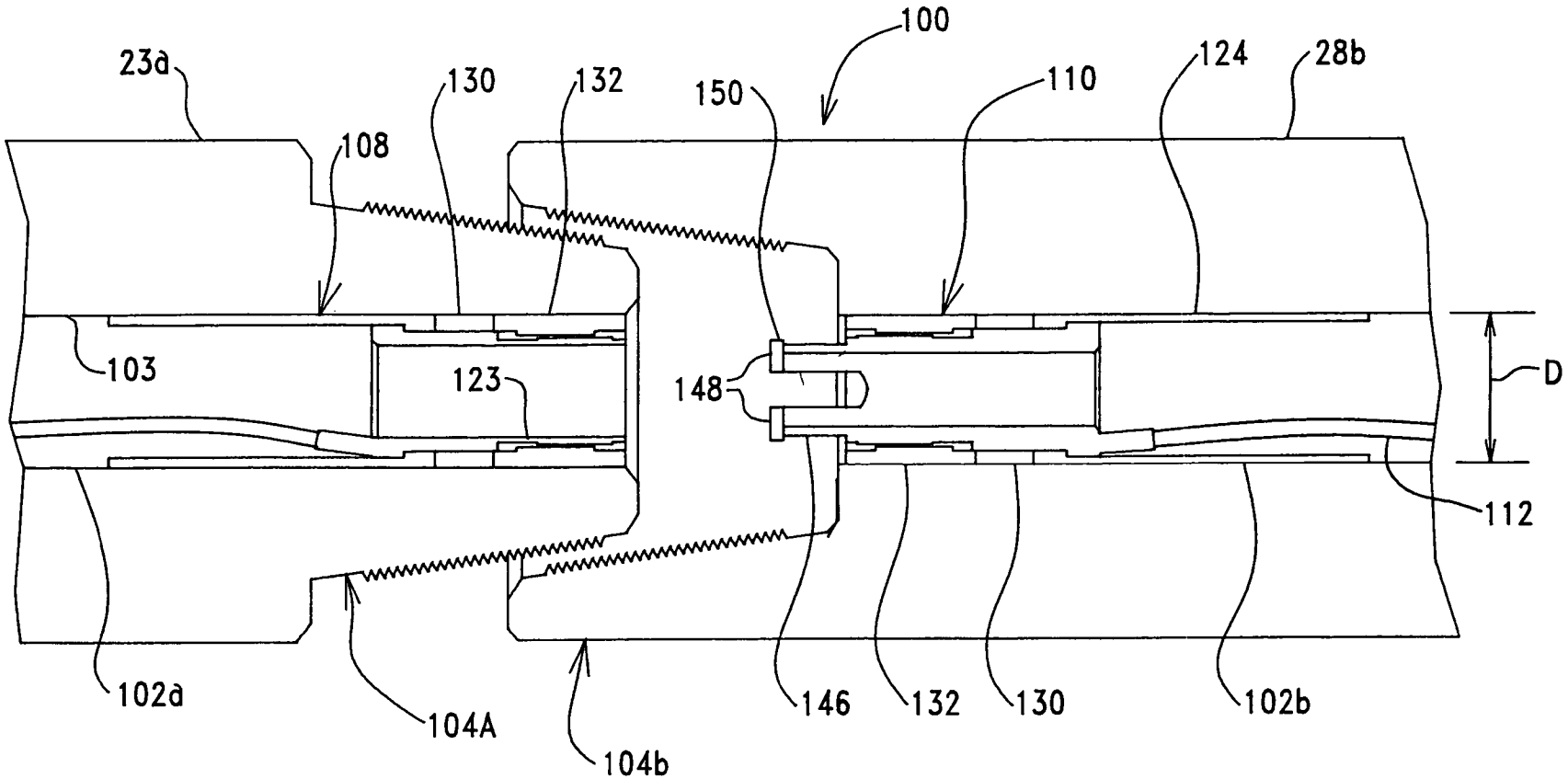
FIG. 2 is a diagrammatic cross-sectional view of adjacent ends of a pair of drill pipe sections shown here to illustrate a first embodiment of an arrangement manufactured in accordance with the present invention for automatically forming a continuous, isolated electrically conductive path between a drill rig and in-ground device.

Having previously described FIG. 1, attention is immediately directed to FIG. 2 which illustrates a first embodiment of an arrangement manufactured in accordance with the present invention and generally indicated by the reference numeral 100 for automatically extending and retracting electrically isolated conductors provided in a segmented drill string. It should be noted that like reference numbers refer to like components throughout the various figures. Moreover, dimensions in the figures have been exaggerated with respect to component sizes and relative spacing for illustrative purposes.

Arrangement 100 is configured for use with standard drill pipe sections such as drill pipe section 28 described above. FIG. 2 illustrates drill pipe sections 28*a* and 28*b* having arrangement 100 installed therein. It should be appreciated that arrangement 100 may be provided as an after market kit for installation in commercially available drill pipe sections which may already be in service or for installation in new drill pipe sections. Alternatively, manufacturers may produce new drill pipe sections having arrangement 100 incorporated therein at the time of manufacture. Drill pipe sections 28 each define through hole 102, indicated by the reference numbers 102*a* and 102*b*, respectively, for drill pipe sections 28*a* and 28*b*. Through holes 102 include a diameter D and define an interior surface 103. Drill pipe section 28*a* includes a threaded pin (male) end fitting 104*a* while drill pipe section 28*b* includes a threaded box (female) end fitting 104*b*. As is typical in the prior art, these end fittings are designed to threadably engage one another, for example, by rotating pin end fitting 104*a* of drill pipe section 28*a* into box end fitting 104*b* of drill pipe section 28*b* during a drilling operation so as to extend the drill string, as described above with regard to FIG. 1. It should be appreciated that the configurations of these end fittings cooperate to produce self alignment as they engage one another, yet produce a suitably strong connection between the drill pipe sections once the end fittings are fully engaged with one another. Moreover, as described with regard to FIG. 1, drilling mud (not shown) is pumped down the drill string and through holes 102*a* and 102*b*. The connection formed between drill pipe sections 28*a* and 28*b* should also prevent the escape of the drilling fluid from the drill string.

Figure 3A:
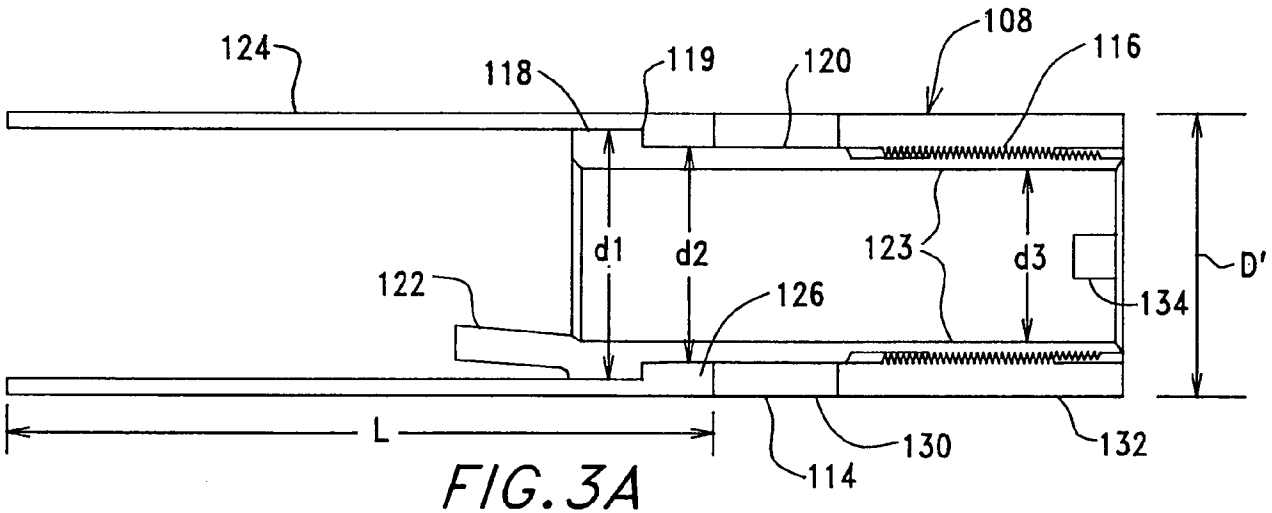
FIG. 3A is a diagrammatic cross-sectional view of a box adapter fitting forming part of the arrangement of FIG. 2 shown here to illustrate details of its construction.
Figure 3B:
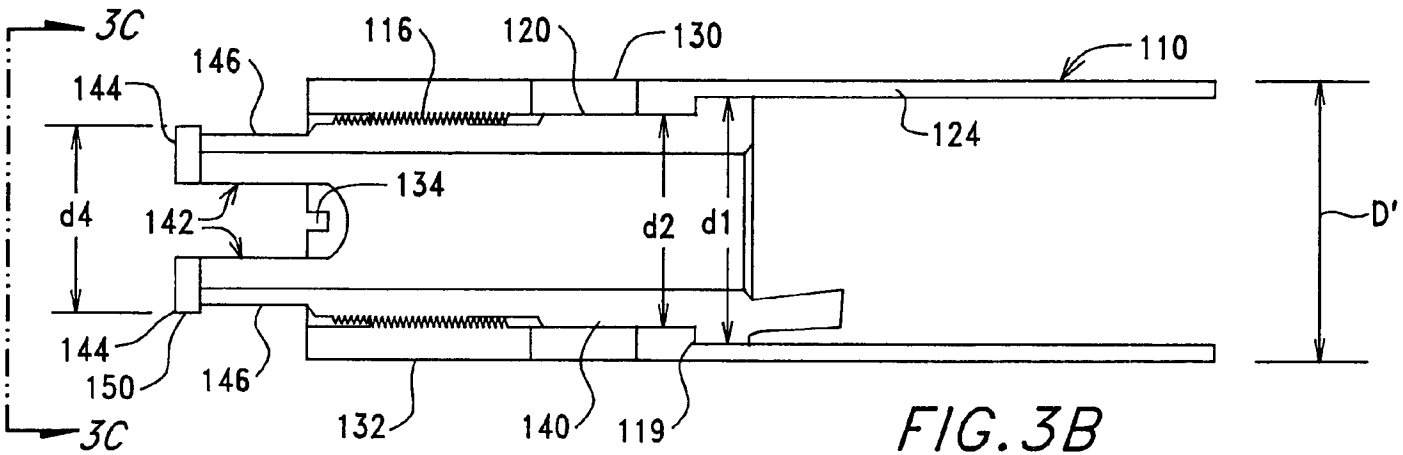
FIG. 3B is a diagrammatic cross-sectional view of a pin adapter fitting forming part of the arrangement of FIG. 2 shown here to illustrate details of its construction and which is configured to mate with the box adapter fitting of FIG. 3A when the fittings are installed in adjacent drill pipe sections.

Referring now to FIGS. 3A and 3B in conjunction with FIG. 2, arrangement 100 includes a box adapter fitting 108 which preferably is positioned in through hole 102*a* of drill pipe section 28*a* and a pin adapter fitting 110 which preferably is positioned in through hole 102*b* of drill pipe section 28*b* for reasons to be described below. FIG. 3A illustrates box adapter fitting 108 while FIG. 3B illustrates pin adapter fitting 110. While only one pair of end fittings of adjacent drill pipe sections have been illustrated, it should be appreciated that each drill pipe section includes opposing ends having a box end fitting at one end and a pin end fitting at its other end. Thus, each drill pipe section in an overall drill string (not shown) receives pin adapter fitting 110 in its box end fitting 104*b* and box adapter fitting 108 in its pin end fitting 104. A length of insulated conductor 112 (only partially shown in FIG. 2) is used to electrically interconnect the pin and adapter fittings associated with each drill pipe section.

Referring primarily to FIG. 3A, box adapter fitting 108 includes a first cylindrically shaped electrically conductive body 114 having a threaded end portion 116, an outwardly projecting peripheral collar 118, having an outer diameter d1, at its opposing end defining a step 119 and an outer peripheral surface 120, having a diameter d2, disposed between peripheral collar 118 and threaded end portion 116. An electrical connection tab 122 extends outwardly from an area of peripheral collar 118 for use in electrical connection with conductor 112 (FIG. 2). The interior surface of conductive body 114 includes a diameter d3 configured to allow the passage of drilling fluid and comprises an electrical contact surface 123. Conductive body 114 may be formed from suitable electrically conductive materials including, but not limited to stainless steel or beryllium copper. A cylindrical electrical insulating sleeve 124 includes a length L and outer diameter D'. Sleeve 124 includes an inwardly projecting peripheral collar 126 defining an entrance diameter approximately equal to d2. The remaining extent of length L of sleeve 124 includes an inner diameter that is slightly greater than d1. Sleeve 124 may be formed from suitable materials such as, for example, Delrin® (acetal). A compression collar 130 is captured between peripheral collar 126 of sleeve 124 and a locking ring 132. The latter is designed to threadably engage threaded end portion 116 of conductive body 114 and is produced from an electrically non-conductive material such as, for example, Delrin®. Alternatively (not shown), locking ring 132 may include a conductive, threaded inner body surrounded on its exterior by an electrical insulating material. Compression collar 130 may be formed from elastomeric materials such as, for example, polyurethane. Locking ring 132 also includes a pair of opposing notches 134 (as shown by a dashed line) which may be utilized in rotating the locking ring relative to conductive body 114. Specific details regarding the installation and operational use of box adapter fitting 108 will be provided at an appropriate point hereinafter following a description of pin adapter fitting 110.

Turning now to FIG. 3B, pin adapter fitting 110 includes a second cylindrically shaped electrically conductive body 140 having threaded end portion 116, peripheral collar 118, including its outer diameter d1, defining step 119 and outer peripheral surface 120, having a diameter d2, disposed between peripheral collar 118 and threaded end portion 116. Electrical connection tab 122 extends outwardly from an area of peripheral collar 118. Conductive body 140, like previously described conductive body 114, may be formed from suitable electrically conductive materials including, but not limited to beryllium copper and defines a through opening 135 for the passage of drilling fluid. Installation of cylindrical electrical insulating sleeve 124, locking collar 130 and locking ring 132 will be described below.

Figure 3C:
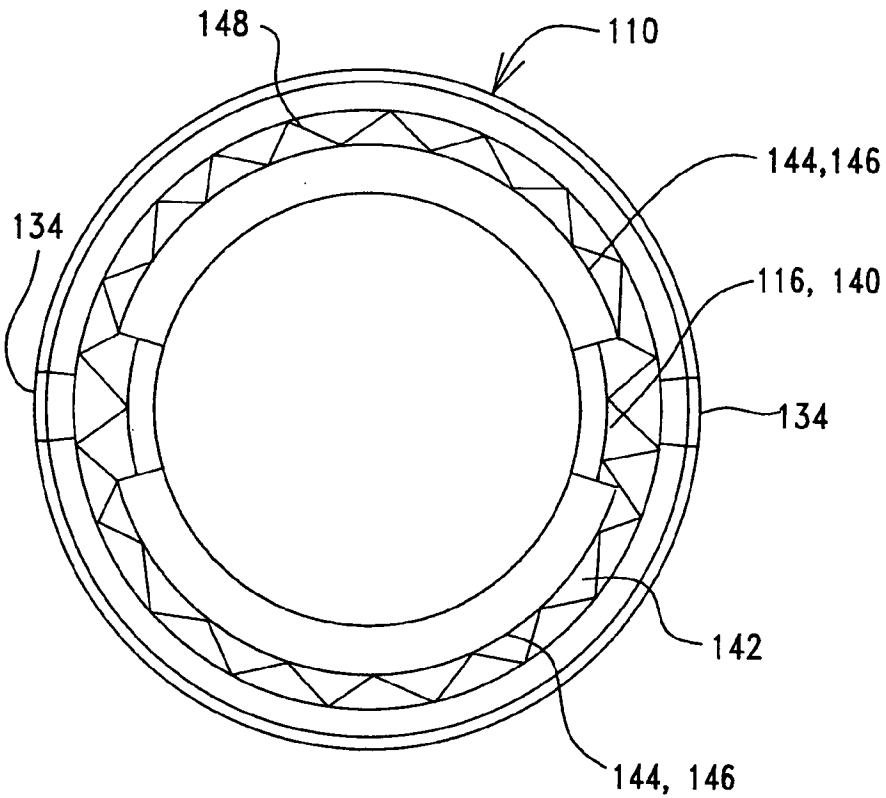
FIG. 3C is an end view of the pin adapter fitting of FIG. 3B shown here to illustrate further details of its construction.

Referring to FIGS. 3B and 3C, second conductive body 140 includes a contact finger arrangement 142 formed as an outermost part of threaded end portion 116. Contact finger arrangement 142 includes an opposing pair of elongated electrical contact fingers 144. Each contact finger includes an elongated contact arm 146 and an end contact 148. Elongated contact arms 146 are preferably integrally formed with conductive body 140. End contacts 148 may be integrally formed with contact arms 146 (not shown) or may be produced separately and attached by any suitable method (as shown) such as, for example, welding. Separately produced end contacts may be formed from suitable electrically conductive materials such as, for example, stainless steel or high strength copper alloy. FIG. 3C shows locking ring 132 threadably engaged with second conductive body 140 using threads 148 of the locking ring and conductive body, where these threads are indicated diagrammatically by a zigzag line. It should be noted that the configuration of contact fingers 144 allows the contact fingers to be biased towards one another such that the contact fingers exert a resilient, outward force against applied inward biasing forces.

Referring to FIGS. 2, 3A and 3B, having generally described the structure of arrangement 100, its installation will now be described. Each adapter fitting is initially assembled by first sliding insulating sleeve 124 onto either conductive body 114 of box adapter fitting 108 or conductive body 140 of pin fitting adapter 110 such that outwardly projecting peripheral collar 118 is received against inwardly projecting peripheral collar 126 of sleeve 124. Compression collar 130 is then positioned on either of the conductive bodies, as shown. Because compression collar 130 is generally formed from elastomeric materials, its inner diameter may be slightly less than d2 so long as the compression collar is positionable as shown. Following installation of the compression collar, locking ring 132 is installed with notches 134 exposed for access thereto.

Following initial assembly of the adapter fittings, installation in a drill pipe section may proceed. Outer diameter D' of box adapter fitting 108 and pin adapter fitting 110 are configured to be less than diameter D of through hole 102 in one of drill pipe sections 102. Therefore, the pin and box adapters are slidably receivable in through hole 102. As illustrated in FIG. 2, box fitting adapter 108 is preferably installed at pin end fitting 104*a* of each drill pipe section while pin fitting adapter 110 is preferably installed at box end fitting 104*b* of each drill pipe section for reasons to be described below.

Installation of the adapters may be performed by first connecting electrical conductor 112 between connection tabs 122 of one box fitting adapter 108 and of one pin fitting adapter 110. Thereafter, for example, pin fitting adapter 110 is inserted, contact finger arrangement 142 first, into through hole 102 at pin end fitting 104*a* of a drill pipe section. Pin fitting adapter 110, with electrical conductor 112 attached, is allowed to slide in the through hole until positioned at box end fitting 104*b* as shown in FIG. 2. At this point, notches 134 of locking ring 132 the pin fitting adapter may be engaged using a specifically configured socket tool (not shown). The locking ring is rotated to compress compression collar 130 between inwardly projecting peripheral collar 126 of insulation sleeve 124 and locking ring 124. As the compression collar is compressed, it expands radially between and against peripheral surface 120 of conductive body 114 or 140 and interior surface 102 (FIG. 2) of a drill pipe section 28. The compression collar is designed to seal against the interior of the drill pipe in order to achieve a tight and secure fit by this radial expansion. In addition, compression collar 130 will allow adapter fittings 108 and 110 to accommodate normal manufacturing variations in the inside diameter of the drill pipe through hole to avoid the need for additional precision machining of the drill pipe. It should be appreciated that use of a threaded engaging configuration permits the removal and/or replacement of the pin and box adapter fittings and/or of other components, such as compression collars 130, by a reverse process and results in a reusable adapter fitting.

Following installation of the pin fitting adapter, as described immediately above, box adapter fitting 108, also connected to conductor 112, is positioned in pin end fitting

104*a* of the drill pipe section and fixed in position in essentially the same manner as pin adapter fitting 110. It should be appreciated that this installation technique may be modified in any suitable manner so long as the illustrated configuration of the adapter fittings and conductor 112 is achieved in the through hole of the drill pipe section. For example, box adapter fitting 108 may be installed first. As another example, conductor 112 may initially be connected to only the adapter fitting to be installed first and, after its installation, with the conductor extending through the drill pipe section, the conductor may be connected to the other adapter fitting prior to its installation.

Turning again to FIG. 2, attention is now directed to the operational use of arrangement 100. FIG. 2 illustrates drill pipe sections 28*a* and 28*b* as these sections are about to be attached with one another. As can be seen in this figure, pin end fitting 104*a* of drill pipe section 28*a* is partially extending within box end fitting 104*b* of drill pipe section 28*b*. In this regard, it should be appreciated that drill pipe sections 28*a* and 28*b* will be brought into substantial alignment by the box and pin end fittings prior to pin adapter fitting 110 engaging box adapter fitting 108. Thus, the possibility of damage to the adapter fittings resulting from misalignment of the drill pipe sections is greatly reduced. With regard to avoiding damage to the adapter fittings, it should be appreciated that installation of pin adapter fitting 110 in box end fitting 104*b* of each drill pipe section affords substantial protection to contact fingers 142 extending outwardly from the through hole of the drill pipe section. That is, installation of pin adapter fitting 110 in pin end fitting 104 of the drill pipe sections (not shown) would cause contact fingers 142 to extrude in a highly exposed manner from the drill pipe section risking damage during virtually any handling of the drill pipe section.

Figure 4:
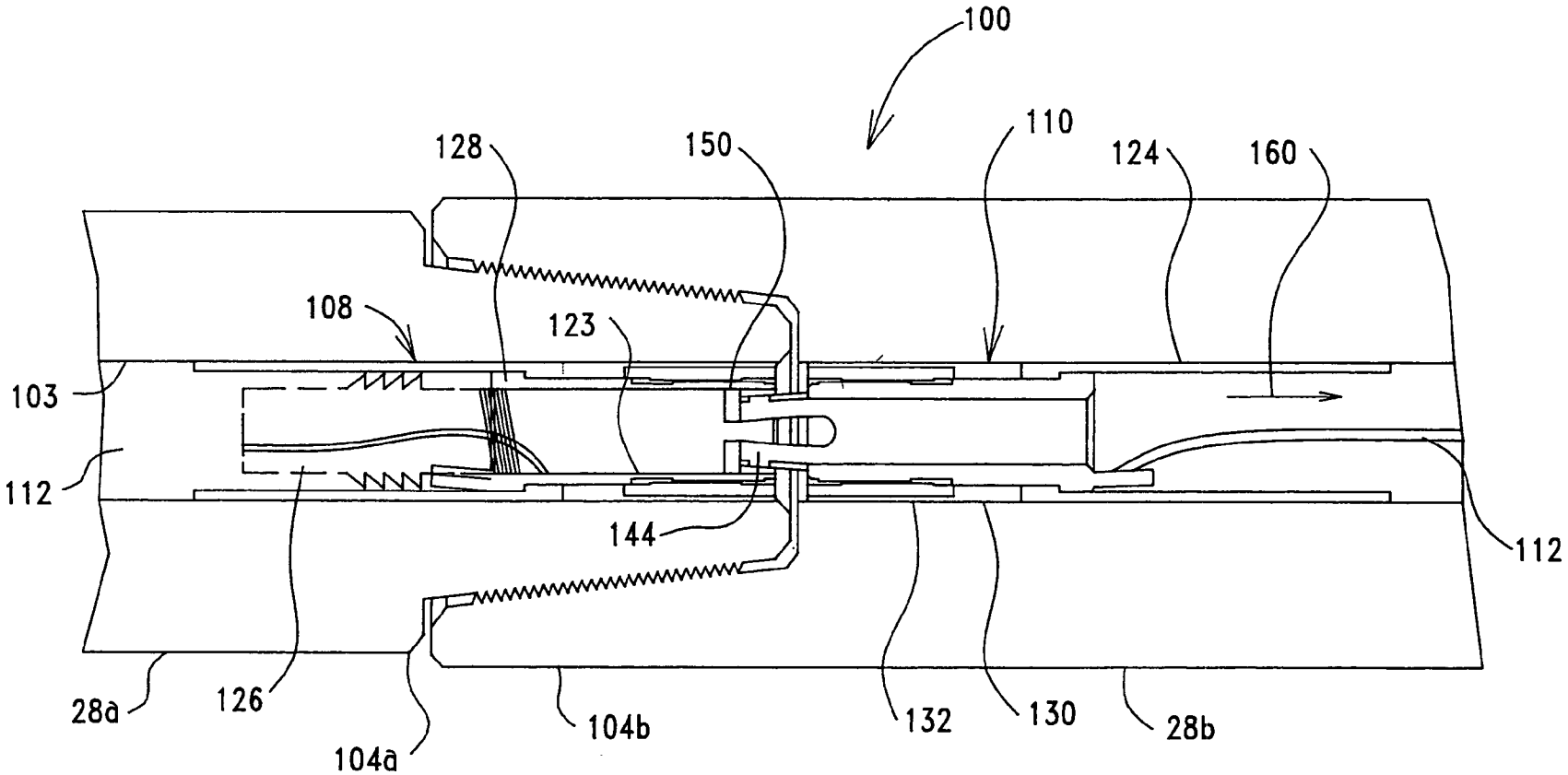
FIG. 4 is a diagrammatic cross-sectional view showing mated, adjacent ends of the pair of drill pipe sections of FIG. 2 illustrating mated pin and box adapter fittings of FIGS. 3A–3C which automatically form a continuous, isolated electrically conductive path in accordance with the present invention.

Referring to FIGS. 2 and 4, as attachment of drill pipe sections 28*a* and 28*b* proceeds from the pre-aligned situation of FIG. 2, pin adapter fitting 110 and box adapter fitting 108 contact one another at a predetermined point (not shown) when substantial alignment has already been achieved between drill pipe sections 28*a* and 28*b*. At this predetermined point, contacts 148 of contact fingers 144 engage electrical contact surface 123 of box adapter fitting 108. As a result, contact finger arms 146 are resiliently biased towards one another in a way which maintains electrical contact between contacts 148 and electrical contact surface 123. Thus, each time an additional drill pipe section is attached to a drill string (not shown) electrical contact is formed between the pin adapter fitting and box adapter fitting, as arranged in the drill pipe section which defines an above ground end of the drill string and the end of the additional drill pipe section to be connected therewith. At the same time, drilling fluid may readily pass through the central through openings defined by the mated box and pin adapter fittings in adjacent drill pipe sections. In accordance with the present invention, arrangement 100 produces an electrically conductive path between a boring tool and a drill rig (such as shown in FIG. 1) in an essentially automatic manner. Arrangement 100 is highly advantageous in this regard since drilling operations need not be interrupted for purposes of maintaining an electrical connection with the boring tool. Therefore, the full advantages attendant to drill rigs configured for automatically adding drill pipe sections to the drill string will be realized while still maintaining a continuous, isolated electrically conductive path between the drill rig and the boring tool. Moreover, this advantage is realized in retraction of the drill string as well as in its advancement. That is, removal of a drill pipe section from the above ground end of the drill string automatically disconnects arrangement 100 within that drill pipe section from the overall continuous, electrically conductive path being maintained between the boring tool and the drill rig. Arrangement 100 is suitable for any application requiring an isolated electrical conductive pathway between the drill rig and the underground end of the drill string. For example, the arrangement may be used with a boring tool to carry electrical power from the drill rig to the boring tool and/or carrying data to and/or from the boring tool. Alternatively, arrangement 100, and other arrangements described below, are useful in utility pullback operations during which it may be useful to send data from the underground end of the drill string to the drill rig. Such information may comprise, for example, tension monitoring data. With regard to utility installation, it should be appreciated that the present invention is useful irrespective of the particular type of utility to be installed. Accordingly, the installation of utilities such as, for example, electrical cables, optically conductive cables, pipes and conduits is contemplated. Such utilities may be installed in a horizontal directional drilling mode or, alternatively, positioned in a pre-existing wellbore such as, for example, an oil well. In the instance of the latter, the present invention may be used in the establishment of communications and/or a network arrangement within a multilateral oil or gas well have radially located components including multiple valves and data acquisition modules, as will be further described.

Referring to FIGS. 3A, 3B and 4, it should be appreciated that typical drilling fluid (not shown) is pumped down the drill string and flows in the direction indicated by an arrow 160. Because the drilling fluid exhibits electrical conductivity, any direct contact between adapter fittings 108 and the drilling fluid (which is itself in physical and electrical contact with ground via the uninsulated interior walls of the drill pipe sections) will create an electrical pathway to ground and cause loss of power and/or signal. Hereinafter, this electrical pathway may be referred to as the drilling fluid ground path. Therefore, insulative, dielectric coatings (not shown) such as, for example, chromium oxide should be used on surfaces exposed to the drilling fluid other than outer faces 150 (see FIG. 3B) of electrical contacts 148 of pin adapter fitting 110 and electrical contact surface 123 (see FIG. 3A) of box adapter fitting 108. Moreover, extension of insulator sleeve 124 into the through hole of each drill pipe section, substantially beyond (not shown) conductive bodies 114 and 140, serves to reduce the drilling fluid ground path.

Alternatively, pin adapter fitting 110 and tube adapter fitting 108 may be held in place by a separate, replaceable single-use barbed fitting 126 which is shown in phantom in FIG. 4. Barbed fitting 126 may include a threaded end 128 which is designed to engage pin adapter fitting 110 and tube adapter fitting 108 thereby eliminating the need for locking ring 132, the threads on the associated conductive bodies and compression sleeve 130. In this way, the adapter fittings may be removed from one drill pipe section and threaded onto threaded end of the installed barbed fitting in another drill pipe section. Alternatively, a broken barbed fitting may readily be replaced at low cost. The barbed fitting may be formed from suitable materials such as, for example, stainless steel. In using a barbed fitting or any other fitting to be deformably received in a drill pipe through hole, connection tab 122, FIG. 4, should be modified to avoid interference. Alternatively, conductor 112 may be connected directly to surface 123 of box adapter fitting 108 or to the interior surface of the pin adapter fitting (neither connection is shown). If barbed fitting 126 is made from an electrically non-conductive material, insulating sleeve 124 may also be eliminated. Like insulating sleeve 124, a non-conductive barbed fitting may extend well into the drill pipe through hole to reduce the electrical pathway formed through the drilling fluid between the conductive bodies of the adapter fittings and ground.

Figure 5:
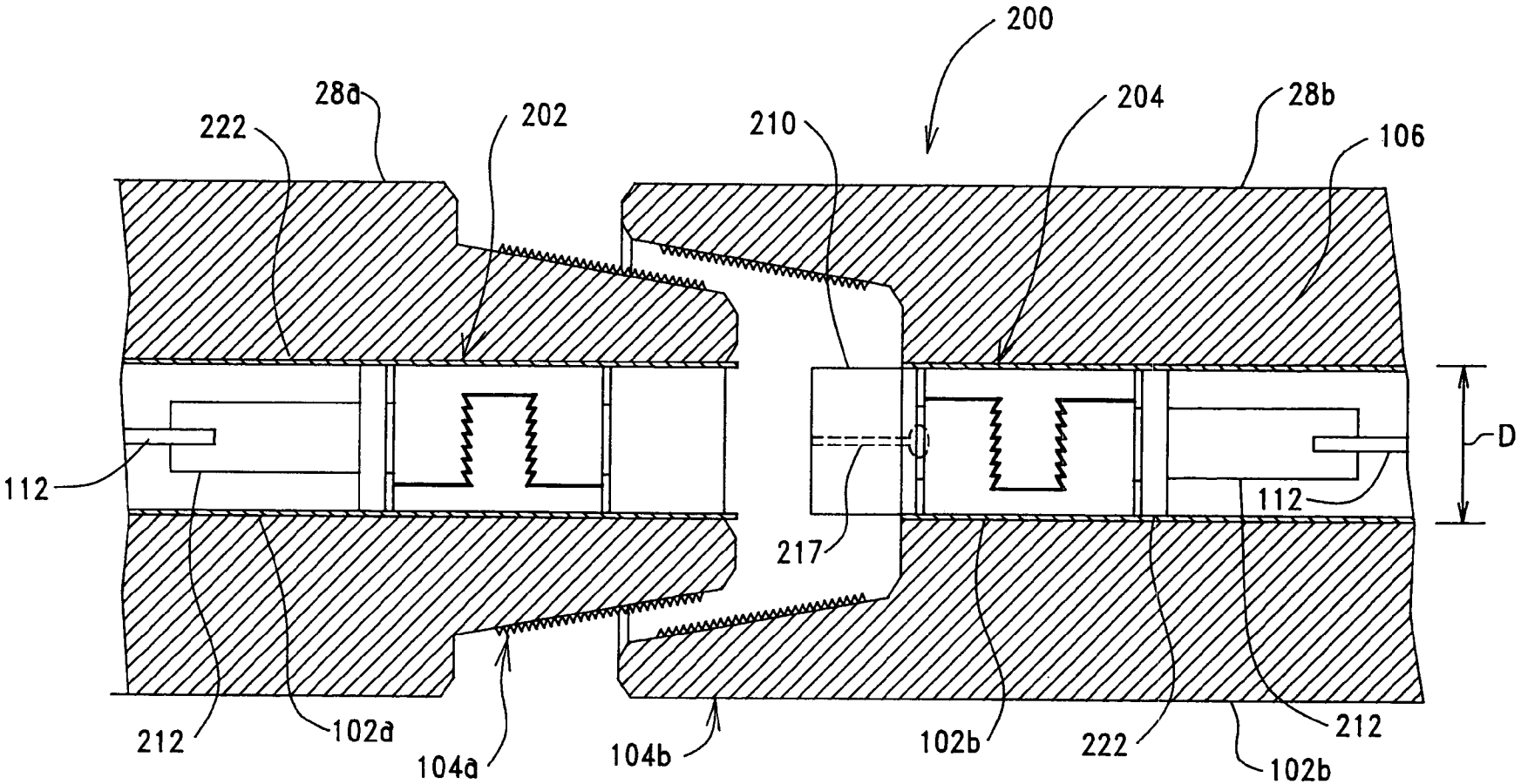
FIG. 5 is a diagrammatic partially cut-away view of adjacent ends of a pair of drill pipe sections shown here to illustrate a second embodiment of an arrangement manufactured in accordance with the present invention for automatically forming a continuous, isolated electrically conductive path between a drill rig and in-ground device.

Attention is now turned to FIG. 5 which illustrates a second embodiment of an arrangement manufactured in accordance with the present invention and generally indicated by reference numeral 200 for automatically extending and retracting electrically isolated conductors provided in a segmented drill string. This figure is a partial cut away plan view having drill pipe sections 28*a* and 28*b* cut away around arrangement 200 for illustrative purposes. Likewise, dimensions in the figures have been exaggerated with respect to component sizes and relative spacing for illustrative purposes.

Like previously described arrangement 100, arrangement 200 is configured for use with standard drill pipe sections such as drill pipe section 28 described above. FIG. 5 illustrates drill pipe sections 28*a* and 28*b* having arrangement 200 installed therein. Further like arrangement 100, it should be appreciated that arrangement 200 may be provided as an after market kit for installation in commercially available drill pipe sections which may already be in service or for installation in new drill pipe sections. Alternatively, manufacturers may produce new drill pipe sections having arrangement 200 incorporated therein at the time of manufacture.

Figure 6C:
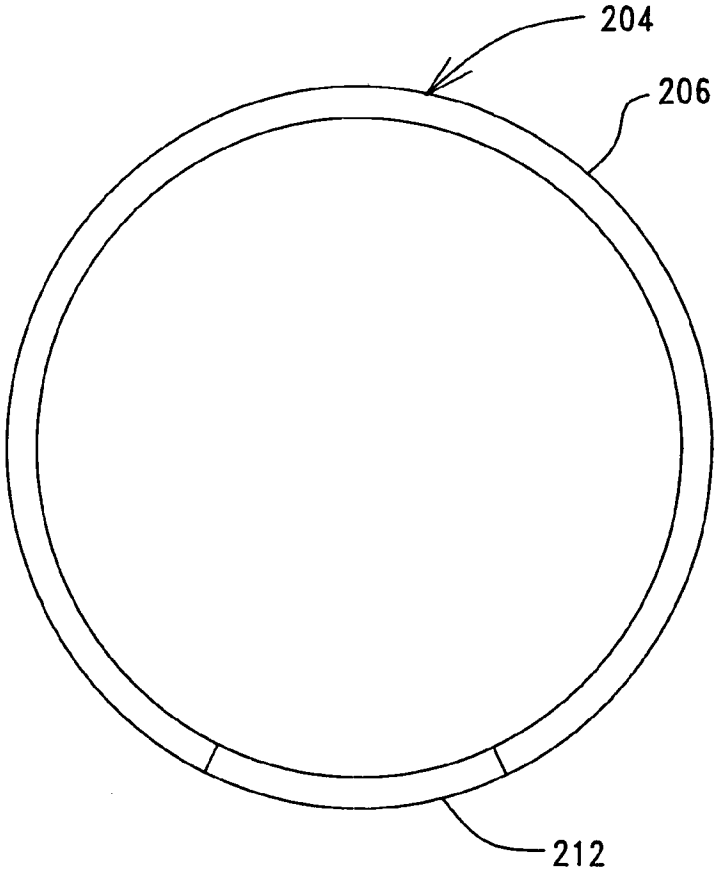
FIG. 6C is an end view of the pin adapter fitting of FIG. 6B shown here to illustrate further details of its construction.
Figure 6A:
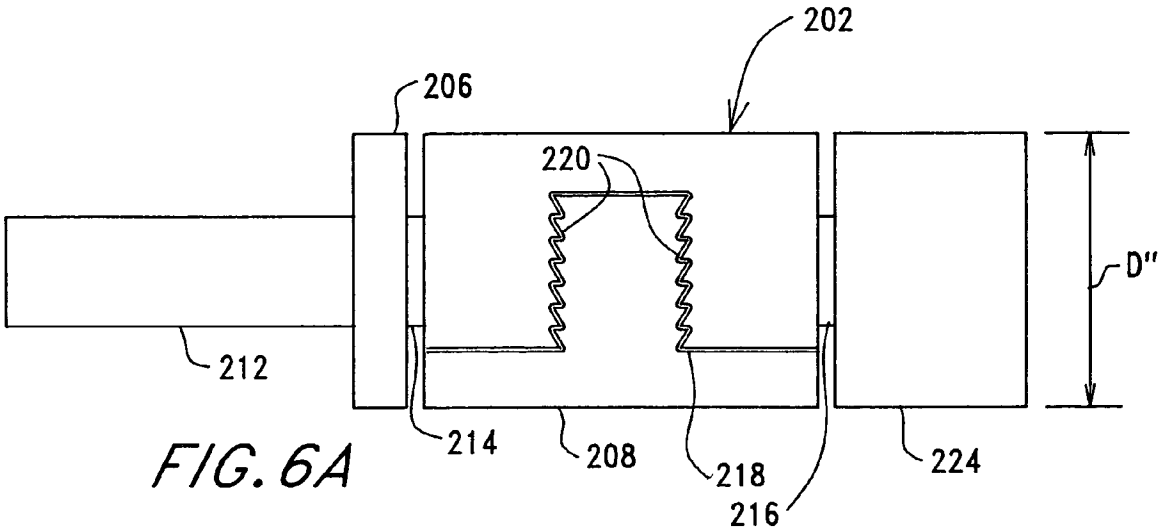
FIG. 6A is a diagrammatic plan view of a box adapter tube fitting forming part of the arrangement of FIG. 5 shown here to illustrate details of its construction.
Figure 6B:
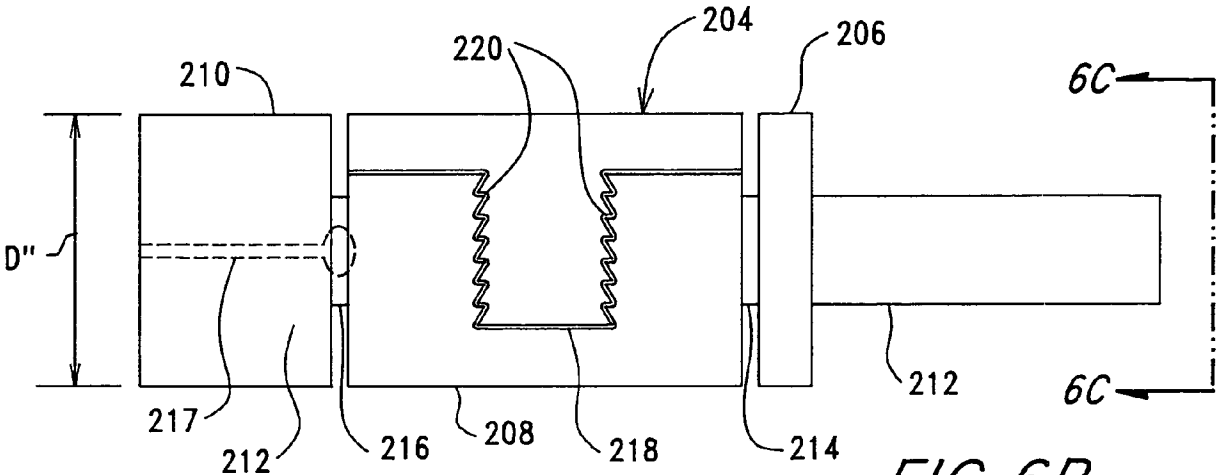
FIG. 6B is a diagrammatic plan view of a pin adapter tube fitting forming part of the arrangement of FIG. 5 shown here to illustrate details of its construction and which is configured to mate with the box adapter tube fitting of FIG. 6A when the adapter tube fittings are installed in adjacent drill pipe sections.

Referring now to FIGS. 6A, 6B and 6C in conjunction with FIG. 5, arrangement 200 includes a box adapter tube fitting 202 which preferably is positioned in through hole 102*a* of drill pipe section 28*a* and a pin adapter tube fitting 204 which preferably is positioned in through hole 102*b* of drill pipe section 28*b* for reasons to be described below. FIG. 6A illustrates box adapter tube fitting 202 in detail while FIG. 6B illustrates pin adapter tube fitting 204 in detail. Even though only one pair of end fittings of adjacent drill pipe sections have been illustrated, it should be appreciated that each drill pipe section includes opposing ends having a box end fitting at one end and a pin end fitting at its other end. Thus, each drill pipe section in an overall drill string (not shown) receives pin adapter tube fitting 204 in its box end fitting 104*b* and box adapter tube fitting 202 in its pin end fitting 104*a*. Insulated conductor 112 (only partially shown in FIG. 5) is used to electrically interconnect the pin and adapter tube fittings associated with each drill pipe section, as will be further described.

First describing pin adapter tube fitting 204 with reference to FIGS. 6B and 6C, the pin adapter tube fitting includes an overall cylindrical shape, which is best seen in the end view of FIG. 6C, having a wall thickness of approximately one-sixteenth of an inch. Other wall thicknesses are equally useful so long as the requirements described below are satisfied. In this regard, it should be appreciated that both the pin and box adapter tubes may be formed from single pieces of tubing, as will be described. Alternately, the various portions of the pin and box adapter tubes to be described can be formed separately (not shown) and interconnected in any suitable manner such as, for example, stainless steel. The pin and box adapter tube fittings may be formed from any suitable material including, but not limited to, stainless steel or high strength copper alloy.

Continuing to describe pin adapter tube fitting 204, a centering ring 206, which is visible in both FIGS. 6B and 6C, a locking body 208 and a pin head arrangement 210 are provided. An arcuate shaped electrical connection tab 212 extends outwardly from centering ring 206 for electrical connection with conductor 112 (FIG. 5). Centering ring 206 and locking body 208 are interconnected by a first arcuate member 214 extending therebetween while pin head arrangement 210 is connected with locking body 208 by a second arcuate member 216. When pin adapter tube fitting 204 is formed from an overall single piece of tubing, arcuate members 214 and 216 are integrally formed with those portions of the pin adapter tube fitting which they serve to interconnect. In cross-section, arcuate members 214 and 216 appear identical to the end view of electrical connection tab 212, as illustrated in FIG. 6C. A compression slot 217 is defined by pin head arrangement 210 and second arcuate member 216 such that circumferential forces around the pin head arrangement will result in a reduced radius. That is, the circumference of the pin head arrangement, particularly at its outermost end can be reduced for reasons to be seen.

Referring to FIG. 6B, locking body 208 includes a specially configured locking cut 218 which extends along the entire length of the locking body and defines two opposing pairs of serrated locking edges 220. The latter are arranged spaced apart from one another and extending partially along the circumference of locking body 208. Owing to suitable flexibility of the material from which the locking body is formed, as well as its thickness, the locking body may be expanded circumferentially in way which causes serrated locking edges 220 of each pair of edges to move in opposite direction directions with respect to one another. During this movement, the serrated edges of each pair are configured so as to engage one another, accomplishing a racheting action which maintains circumferential expansion of the locking body.

Referring to FIGS. 5, 6B and 6C, pin adapter tube fitting 204 includes a diameter D" which is designed to be received in an overall insulating tube 222 (see FIG. 5) that is, in turn, received in through hole 102. The pin adapter tube fitting, in combination with insulating tube 222, includes an outer diameter which is less than diameter D of through hole 102 of the drill pipe sections. With serrated edges 220 disengaged, the pin adapter tube fitting received in insulating tube 222 is slidably receivable in through hole 102. Insulating tube 222 may be formed from suitable electrical insulating materials such as, for example, polyurethane which also exhibit at least a certain degree of deformability, for reasons which will become evident. During installation, the pin adapter tube fitting and insulating sleeve are installed within through hole 102*b* of drill pipe section 28*b* such that pin head fitting 210 extends from the through hole into box end fitting 104*b*. Thereafter, locking body 208 is circumferentially expanded against insulating tube 222 to engage locking edges 220 which, in turn, expands against the interior surface of the through hole and is captured between locking body 208 and the interior surface of the through hole. Expansion of locking body 208 to engage serrated edges 220 may be accomplished, for example, by using a swaging tool. For reasons to be described, insulating tube 222 should protrude slightly into box end fitting 104*b*.

Referring to FIGS. 5, 6A and 6B, box adapter tube fitting 202 is essentially identical to pin adapter tube fitting 204 with the exception that pin head arrangement 210 is replaced by a box head arrangement 224. The latter is cylindrical including outer diameter D". Thus, as will be further described, pin head arrangement 210 of the pin adapter tube fitting, through circumferential compression, may be inserted into box head arrangement 224 of box adapter tube fitting 202. The latter is installed in through hole 102*b* of drill pipe section 28*a* such that the outermost end of box head arrangement is generally flush with the end of pin end fitting 104*a*. At the same time, insulating tube 222 around box adapter tube fitting 204 should extend slightly from through hole 102*a* at pin end fitting 104*a*, as will be further described. The box adapter tube fitting and its associated insulating tube 222 are installed in the same manner as described previously with regard to pin adapter tube fitting 204 using locking body 208.

Figure 7:
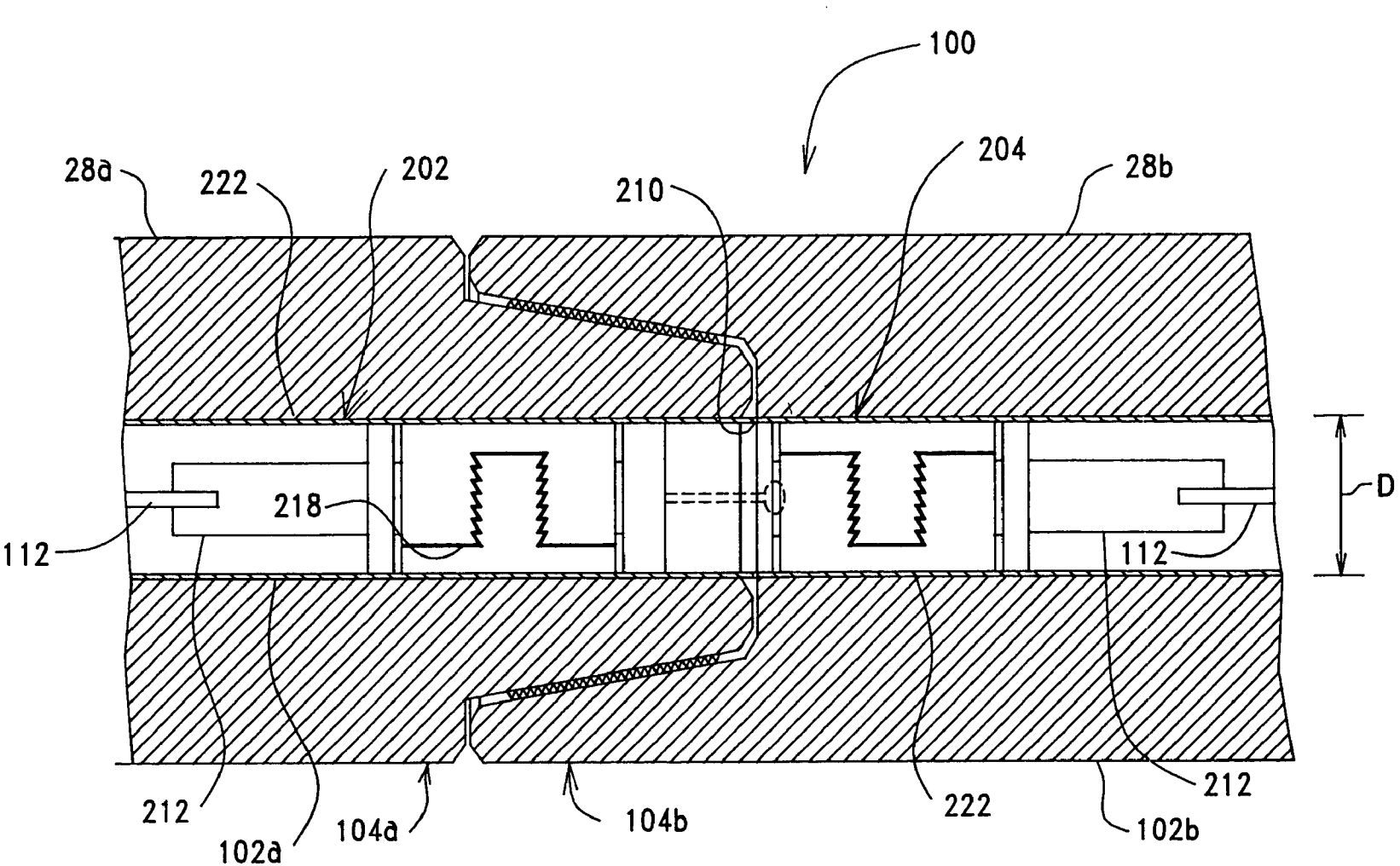
FIG. 7 is a diagrammatic cross-sectional view showing mated, adjacent ends of the pair of drill pipe sections of FIG. 5 illustrating mated pin and box adapter tube fittings according to FIGS. 6A–6C which automatically form a continuous, isolated electrically conductive path in accordance with the present invention.

During operation, with reference primarily taken to FIGS. 5 and 7, pin head fitting 210 of pin adapter tube fitting 204 engages box head arrangement 224 of box adapter tube fitting 202 at a predetermined point once box end fitting 104*b* and pin end fitting 104*a* have engaged one another and are pre-aligned. As engagement of the drill pipe sections proceeds, pin head arrangement 210 is circumferentially compressed by box head arrangement 224 so as to be inserted within the box head arrangement, forming an electrical connection therewith. Thus, an electrical pathway is automatically formed between drill pipe sections as the drill pipe sections are connected with one another. Like previously described arrangement 100, exposed portions of arrangement 200 which contact drilling mud may be coated with dielectric materials in order to isolate the connectors from ground connection via the drilling mud. This isolation is further enhanced by extending insulating tubes 222 further into the interior of the drill pipe section through holes. In this regard, insulating tubes 222 associated with the pin and box adapter tube fitting should extend sufficiently from their associated through holes such that the ends of the insulating sleeves are biased against one another as illustrated in FIG. 7. In this way, electrical conduction to ground is further reduced.

It should be appreciated that arrangement 200 shares all the advantages of previously described arrangement 100 with regard to establishing an isolated electrically conductive path between a boring tool and drill rig. Moreover, because arrangement 200 may be produced at low cost from tubular stock, it is designed for a single use. Locking cut 218 may be cut (not shown), for example, using a laser with an appropriate shield positioned within the tubular stock. In fact, both the box and pin adapter tubes may be cut entirely using a laser.

Figure 8:
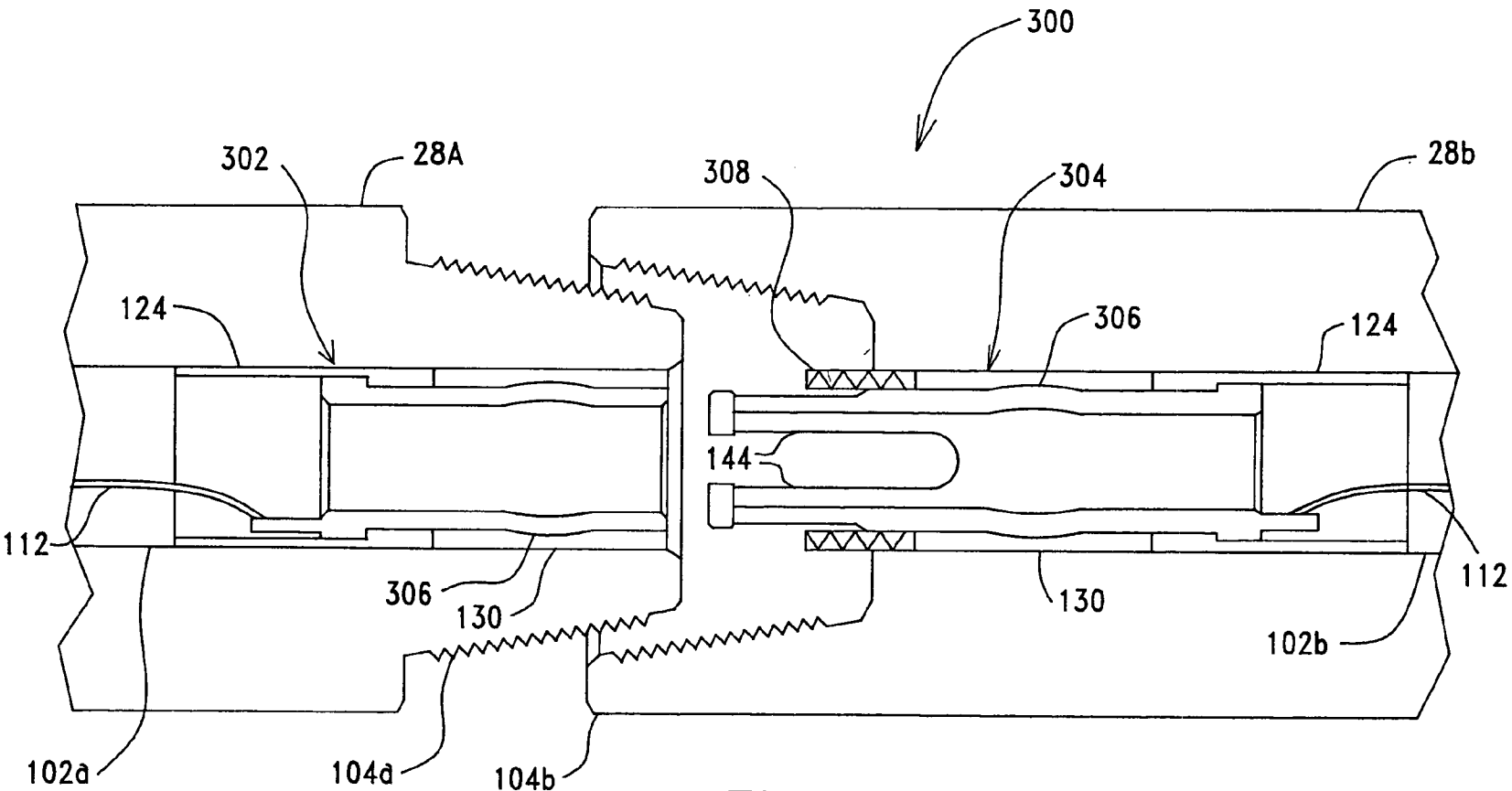
FIG. 8 is a diagrammatic cross sectional view of adjacent ends of the pair of adjacent drill pipe sections shown here to illustrate a third embodiment of an arrangement manufactured in accordance with the present invention for automatically forming a continuous, isolated electrically conductive path between a drill rig and in-ground device.

FIG. 8 illustrates a third embodiment of an arrangement manufactured in accordance with the present invention and generally indicated by reference numeral 300 for automatically extending and retracting electrically isolated conductors provided in a segmented drill string. As in previously described embodiments, arrangement 300 is configured for use with standard drill pipe sections such as drill pipe section 28. FIG. 8 illustrates drill pipe sections 28*a* and 28*b* having arrangement 300 installed therein and with the adjacent drill pipe sections in partial alignment. Furthermore, it should be appreciated that arrangement 300 may be provided as an after market kit for installation in commercially available drill pipe sections which may already be in service or for installation in new drill pipe sections.

Arrangement 300 includes a box adapter fitting 302 which preferably is positioned in through hole 102*a* of drill pipe section 28*a* and a pin adapter fitting 304 which preferably is positioned in through hole 102*b* of drill pipe section 28*b* for reasons described above with regard to protection of the adapter fittings during drilling operations. Each drill pipe section in an overall drill string (not shown) receives pin adapter fitting 304 in its box end fitting 104*b* and box adapter fitting 302 in its pin end fitting 104*a*. Insulated conductor 112 (only partially shown in FIG. 8) is used to electrically interconnect the pin and adapter fittings associated with each drill pipe section, as described above.

Inasmuch as arrangement 300 is similar to arrangement 100 described above, present discussions will be limited primarily to features of arrangement 300 which differ from those of arrangement 100. These features relate for the most part to the manner in which the fittings are mounted in the drill pipe section through holes. Specifically, adapter fittings 302 and 304 each include a deformable conductive body 306 which, in its undeformed condition, is intially inserted into the drill pipe through holes and, thereafter, deformed in a way which squeezes compression sleeve 130 against the interior surface of the drill pipe section through hole to hold the adapter fittings in position. The deformable conductive body may be integrally formed (i.e., including contact fingers 144) from suitable materials such as, for example, stainless steel. Installation of the adapter fittings into drill pipe sections will be described below. Another feature incorporated in arrangement 300 is a bellows seal 308 which is attached to pin adapter fitting 304, for example, by an interference fit. Bellows seal 308 will be described in further detail at an appropriate point below. For the moment, it should be noted that the bellows seal feature may be utilized in any embodiment of the present invention.

Figure 9:
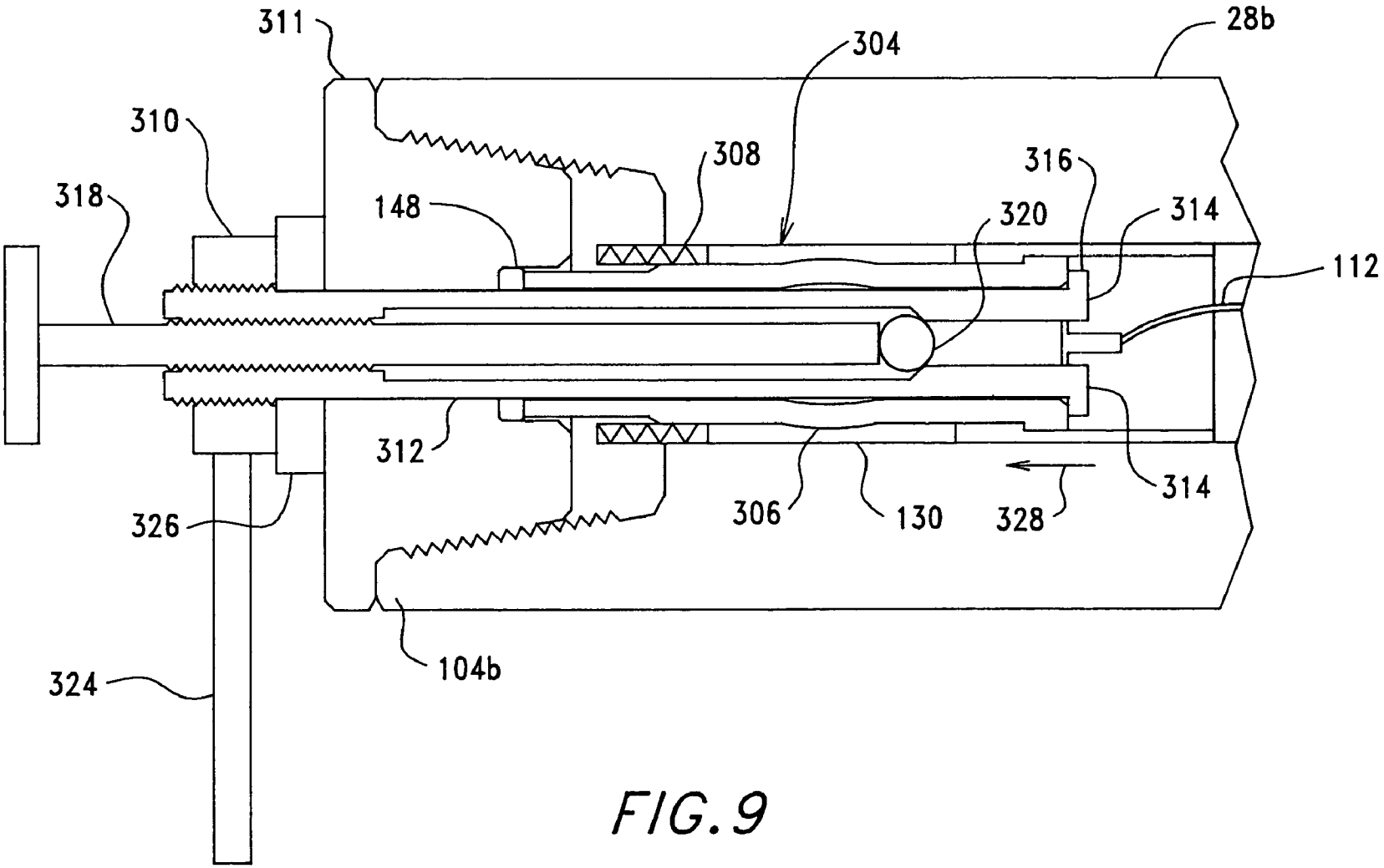
FIG. 9 is a diagrammatic cross sectional view of a tool used in installing adapter fittings which form part of the embodiment illustrated in FIG. 8.

Attention is now directed to FIG. 9 for purposes of describing the installation of adapter fittings 302 and 304 within drill pipe sections 28. Specifically, this figure illustrates installation of pin adapter fitting 304 in drill pipe section 28*b*. Installation is facilitated using an installation tool 310. Initially, pin adapter fitting 304 is assembled and prepared for installation generally arranged in the manner illustrated, but with deformable conductive body 306 in an undeformed condition. Installation tool 310 includes a plug fitting 311 which threadably engages box end fitting 104*b* of the drill pipe section. A pulling arm body 312 of tool 310 extends through plug fitting 311 and defines opposing, elongated pulling arms 314 having outwardly extending hook portions 316 at their ends. The pulling arm body is configured for lateral movement relative to plug fitting 311 by a threaded arrangement. The pulling arms themselves are configured such that, in the absence any external forces, hook portions 316 move towards one another (not shown) such that the hook portions may be inserted into the central through opening of pin adapter fitting 304 for positioning as illustrated whereby to allow plug fitting 311 to be threaded into box end fitting 104*b*. Thereafter, a T-handle 318 forming part of tool 310 is turned in a way which engages a ball bearing 320 with locking arms 314 to move the locking arms radially outwardly such that hook portions 316 are in position to engage the adapter fitting with lateral movement of the hook portions. At this point, a locking handle 324, which threadably engages pulling arm body 312, is turned so as to bias a washer 326 against plug fitting 311 to move the pulling arm body and, hence, the hook portions laterally in the direction indicated by an arrow 328. Sufficient force applied using the locking handle causes deformable body 306 of the adapter fitting to deform outwardly against compression sleeve 130, as illustrated, to lock pin adapter fitting 304 in position. It should be appreciated that end contacts 148 engage plug fitting 311 as the adapter fitting is moved in the direction of arrow 322. Therefore, proper lateral positioning of the adapter fitting is automatically achieved using tool 310. T-handle 318 is then backed off to disengage ball bearing 320 from locking arms 314 such that tool 310 may be removed from installed pin adapter fitting 304. Installation of box adapter fitting 302 is performed in essentially the same manner except that the configuration of plug fitting 311 is modified (not shown) to accommodate the use of the tool with pin end fitting 104*a* of a drill pipe section and to facilitate automatic positioning of box adapter fitting 302.

Figure 10:
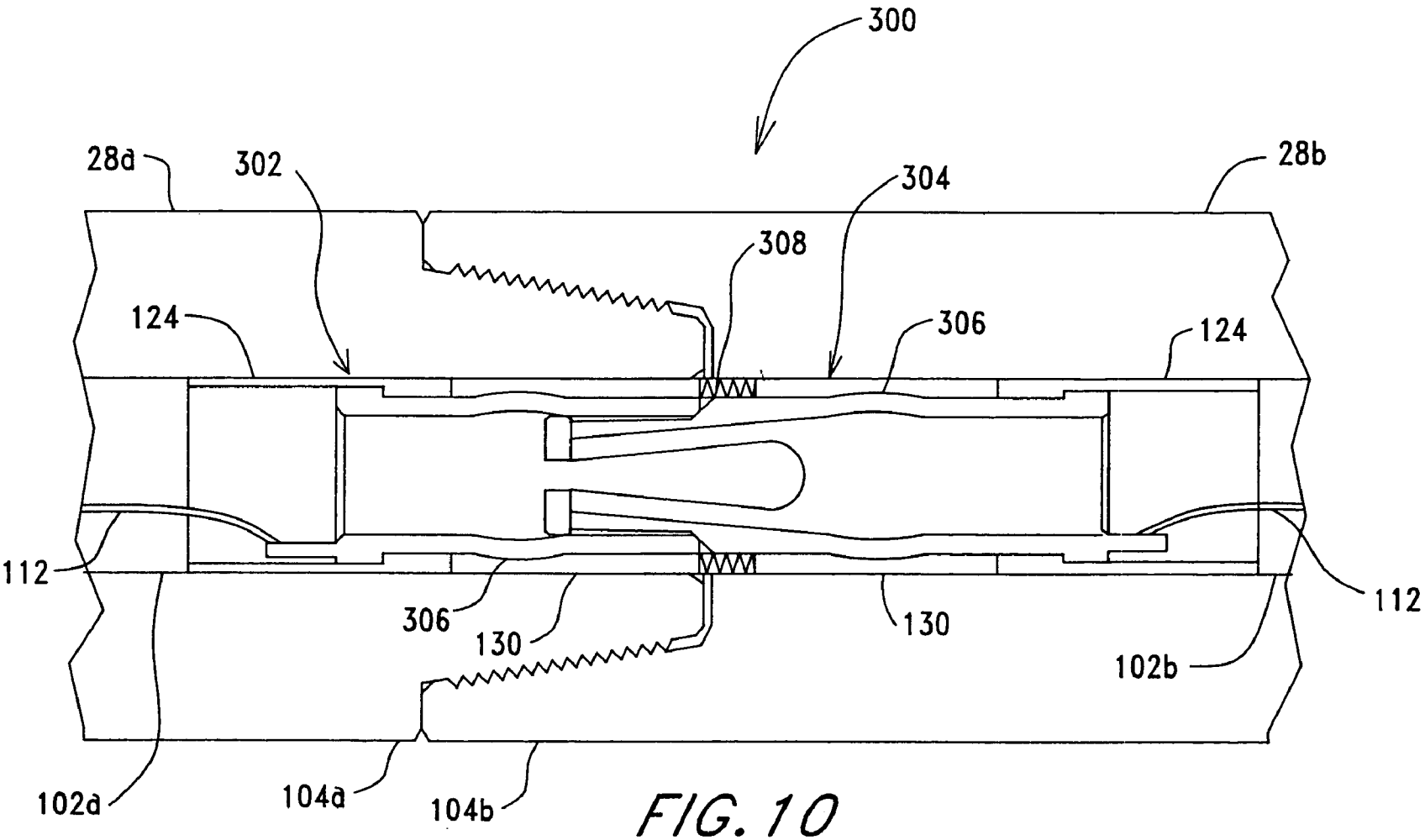
FIG. 10 is diagrammatic cross-sectional view showing mated, adjacent ends of the pair of drill pipe sections of FIG. 8 illustrating mated pin and box adapter fittings according to the third embodiment of the invention which automatically form a continuous, isolated electrically conductive path.

FIG. 10 illustrates drill pipe sections 28*a* and 28*b* mated and having adapter fittings 302 and 304 installed and mated therein. It should be appreciated that descriptions above relating to arrangement 100 are equally applicable to arrangement 300 with regard to adapter fittings 302 and 304 engaging one another as the drill pipe sections are joined. Moreover, arrangement 300 shares all of the advantages described above with regard to arrangement 100. In addition, as the drill pipe sections engage one another, bellows 308 is compressed between adapter fittings 302 and 304 so as to lengthen the ground path between the adapter fittings and the drill pipe sections (via drilling fluid) for purposes described previously. It should be appreciated that bellows 308 may readily be used in arrangement 100 described above. Bellows 308 may be formed from any suitable material including, but not limited to polyurethane. Mounting of the bellows, as described above, may advantageously accommodate replacement of the bellows in the event of damage.

Figure 11:
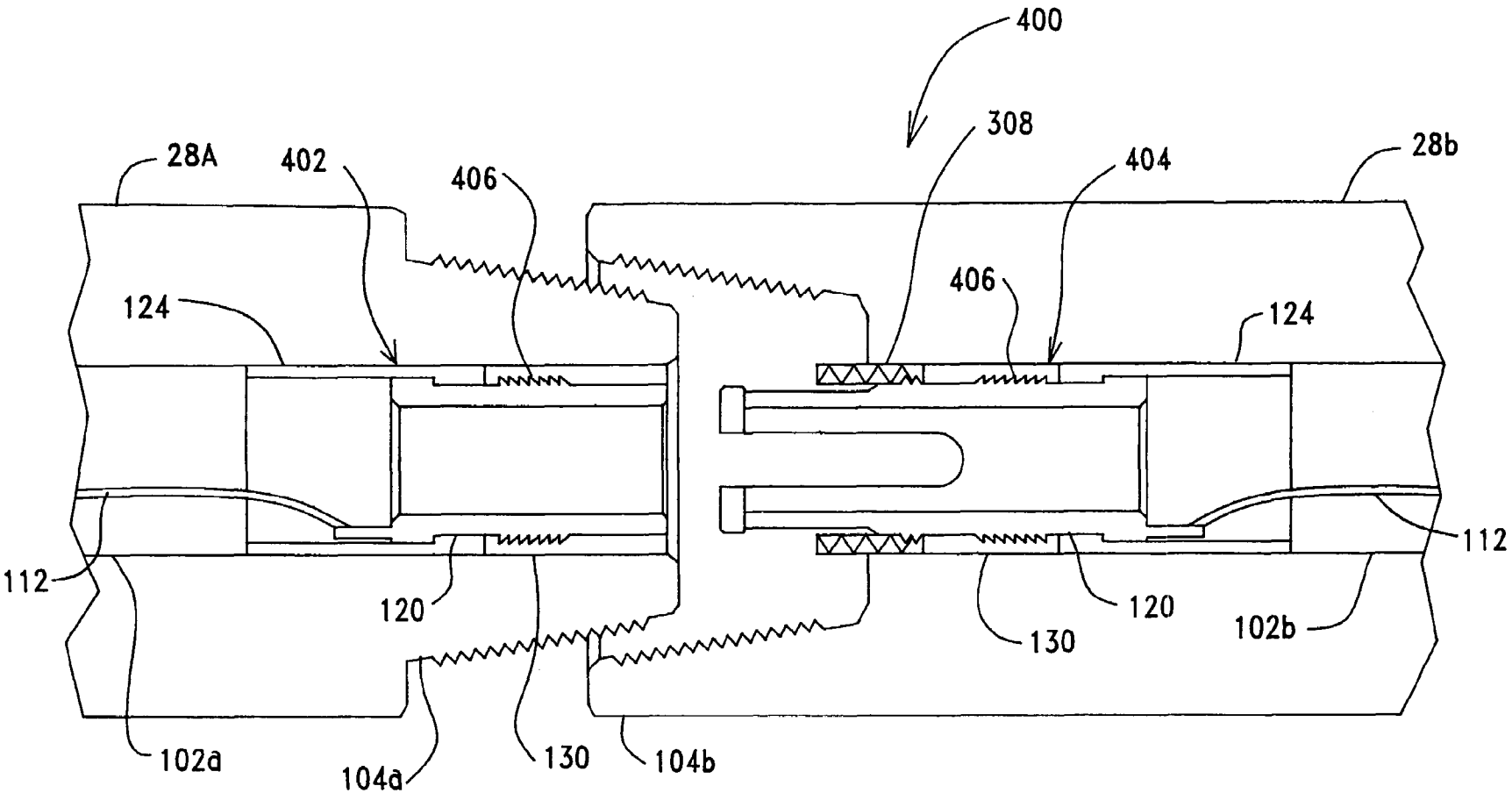
FIG. 11 is a diagrammatic cross sectional view of adjacent ends of the pair of adjacent drill pipe sections shown here to illustrate a fourth third embodiment of an arrangement manufactured in accordance with the present invention for automatically forming a continuous, isolated electrically conductive path between a drill rig and in-ground device.

FIG. 11 illustrates a fourth embodiment of an arrangement manufactured in accordance with the present invention and generally indicated by reference numeral 400 for automatically extending and retracting electrically isolated conductors provided in a segmented drill string. Once again, arrangement 300 is configured for use with standard drill pipe sections such as drill pipe section 28. FIG. 11 illustrates drill pipe sections 28*a* and 28*b* having arrangement 400 installed therein and with adjacent drill pipe sections in partial alignment. The present embodiment may be provided as an after market kit for installation in commercially available drill pipe sections already in field service or for incorporation by manufacturers producing new drill pipe sections.

Arrangement 400 includes a box adapter fitting 402 which preferably is positioned in through hole 102*a* of drill pipe section 28*a* and a pin adapter fitting 404 which preferably is positioned in through hole 102*b* of drill pipe section 28*b* for reasons described above with regard to protection of the fittings during drilling operations. Each drill pipe section in an overall drill string (not shown) receives pin adapter tube fitting 404 in its box end fitting 104*b* and box adapter tube fitting 402 in its pin end fitting 104*a*. Insulated conductor 112 (only partially shown in FIG. 11) is used to electrically interconnect the pin and adapter tube fittings associated with each drill pipe section, as described above.

Because arrangement 400 is similar to arrangements 100 and 300 described above, present discussions will be limited primarily to features of arrangement 400 which differ from those of arrangements 100 and 300. Once again, these features relate, for the most part, to the manner in which the fittings are mounted in the drill pipe section through holes. Specifically, adapter fittings 402 and 404 each include a barbed portion 406 defined by outer peripheral surface 120. Barbed portion 406 engages compression sleeve 130 in a way which radially forces the compression sleeve outwardly against the inner surface of each drill pipe section through hole. It is noted that bellows 308 is present for purposes described above. The installation process (not shown) of adapter fittings 402 and 404 in their respective drill pipe sections may be accomplished, for example, by first inserting the adapter fitting assembly in a though hole without compression sleeve 130. Thereafter, the compression sleeve may be inserted such that compression sleeve 130 is immediately adjacent the opening leading into the through hole and the remainder of the adapter is immediately adjacent the compression sleeve but behind the compression sleeve. Using a tool that is similar to tool 310 of FIG. 9, but which includes appropriate modifications, adapter fitting 402 or 406 may then be drawn forward, toward the opening of the through hole while retaining compression sleeve 130 and bellows 308 in position such that barbed portion 406 engages compression sleeve 130. The adapter fitting is drawn forward to the extent required to arrive at the illustrated configuration. For purposes of brevity, mated drill pipe sections bearing adapter fittings 402 and 406 are not illustrated since these adapter fittings engage in the manner illustrated in FIG. 4 for arrangement 100 and in FIG. 10 for arrangement 300. It should be appreciated that, arrangement 400 shares all of the advantages described above with regard to previously described arrangements. An extraction tool can be used to remove the connection adapters for replacement.

Figure 12:
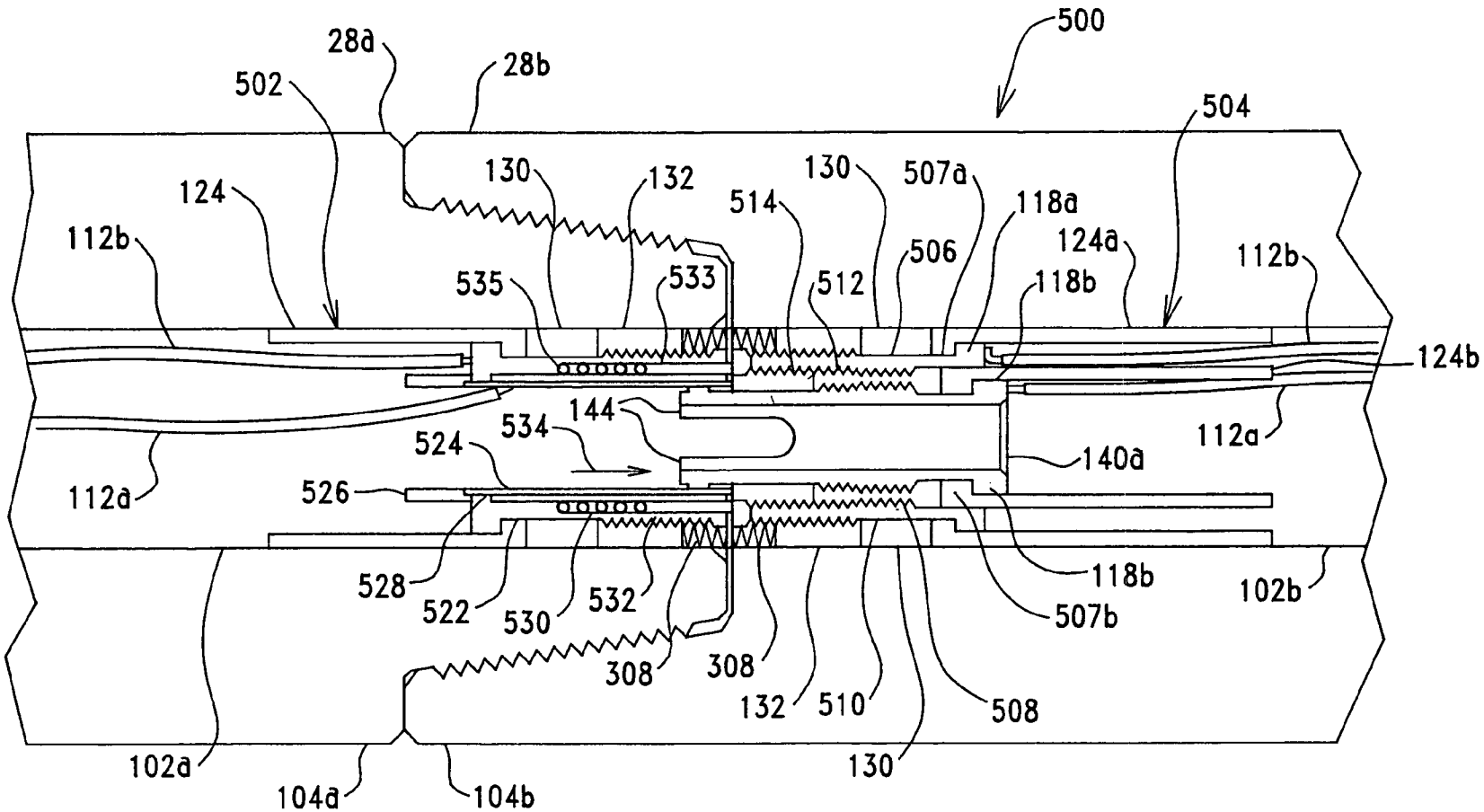
FIG. 12 is a diagrammatic cross sectional view of adjacent ends of the pair of adjacent drill pipe sections shown here to illustrate a multi-conductor embodiment of an arrangement manufactured in accordance with the present invention for automatically forming two continuous, isolated electrically conductive paths between a drill rig and in-ground device.

Attention is now directed to FIG. 12 which illustrates a multiple conductor arrangement manufactured in accordance with the present invention and generally indicated by reference numeral 500 for automatically extending and retracting two different (i.e., parallel) isolated conductors provided in a segmented drill string. As in previously described embodiments, arrangement 500 is configured for use with standard drill pipe sections such as drill pipe section 28. FIG. 12 illustrates drill pipe sections 28*a* and 28*b* having arrangement 500 installed therein and with the adjacent drill pipe sections attached to one another. Furthermore, it should be appreciated that arrangement 500 may be provided as an after market kit for installation in commercially available drill pipe sections which may already be in service or for installation in new drill pipe sections.

Arrangement 500 includes a multi-conductor box adapter fitting 502 which preferably is positioned in through hole 102*a* of drill pipe section 28*a* and a multi-conductor pin adapter fitting 504 which preferably is positioned in through hole 102*b* of drill pipe section 28*b* for reasons described above with regard to protection of the adapter fittings during drilling operations. The two conductive paths established by arrangement 500 will be referred to as the "inner" and "outer" conductive paths for descriptive reasons and for purposes of clarity. Adapter fittings 502 and 504 have been named in accordance with the configuration of the inner conductive path since this configuration will be familiar to the reader from previous descriptions. Each drill pipe section in an overall drill string (not shown) receives multi-conductor pin adapter fitting 504 in its box end fitting 104*b* and multi-conductor box adapter fitting 502 in its pin end fitting 104*a*. Insulated conductors 112*a* (only partially shown) are used to electrically interconnect the components associated with the inner conductive path while insulated conductor 112*b* is used to electrically interconnect the components associated with the outer conductive path.

Still referring to FIG. 12, arrangement 500 includes an insulating sleeve 124*a* which is similar to previously described insulating sleeve 124. It is noted that the identification letter "a" has been appended to the reference number 124 for purposes of clarity since another similarly configured insulating sleeve is associated with the inner conductive path. Identification letters have been appended to reference numbers where appropriate to ensure clarity. An outer path conductive body 506 engages an inwardly projecting collar 507*a* of insulating sleeve 124*a* using an outwardly projecting collar 118*a*. Compression collar 130 is positioned around outer path conductive body 506 immediately adjacent to insulating sleeve 124*a*. Locking ring 132 is threadably engaged with the outer path conductive body. In this regard, multi-conductor box adapter fitting 502 is similarly configured using insulating sleeve 124, compression collar 130 and locking ring 132. It should be appreciated that installation of adapter fittings 502 and 504 within a drill pipe through hole is accomplished in essentially the same manner as described previously with regard to arrangement 100 using the locking ring/compression collar configuration. Arrangement 500 also includes bellows 308 on both the multi-conductor box and pin adapter fittings for reducing the drilling fluid ground path. Moreover, dielectric coatings may be applied to conductive portions of the fittings except, of course, at electrical contact points. Outer path conductive body 506 defines a through opening which receives an inner path conductive body 140*a* and supporting components to be described immediately hereinafter.

Continuing to refer to FIG. 12, inner path conductive body 140*a* is similar in configuration to conductive body 140 in defining contact fingers 144. Inner path conductive body 140*a* is received in outer path conductive body 506 using an inner insulating sleeve 124*b* having an inwardly projecting collar 507*b* which engages outwardly projecting collar 118*b* formed by the inner path conductive body. An electrically insulating thread ring 508 bears both inner and outer threads and may be formed from suitable materials including, but not limited to Delrin®. The inner threads of thread ring 508 are threadably engaged with threads 510 defined by inner path conductive body 140*a* so as to bias inner insulating sleeve 124*b* against peripheral collar 118*b* of the inner path conductive body. Outer threads of thread ring 508 are, in turn, threadably engaged with inner threads 512 defined by outer path conductive body 506. An insulating ring 514 bearing only an outer thread is engaged with the inner thread of outer path conductive body 506 to minimize contact between the inner path conductive body and drilling fluid (not shown) whereby to reduce the aforementioned drilling fluid ground path. Assembly of multi-conductor pin adapter fitting 504 proceeds by placing inner insulating sleeve 124*b* onto inner path conductive body 140*a* followed by threading on thread ring 508. This assembly is then threaded into outer path conductive body 506, as shown. Insulating ring 514 is then passed over contact fingers 144 and threadably engaged with outer path conductive body 506. Thereafter, outer insulating sleeve 124*a* is installed, followed by compression collar 130 and locking ring 132. Bellows 308 may be secured, for example, using an interference fit which allows for ready replacement of the bellows with operational wear and tear. Installation of multi-conductor pin adapter fitting 506 in drill pipe through hole 102*b* is accomplished in the manner described with regard to arrangement 100, as described above. Conductors 112*a* and 112*b* may be attached, for example, by spot welding (not shown).

Having described multi-conductor pin adapter fitting 504, a description will now be provided of multi-conductor box adapter fitting 502. The latter includes an outer conductive member 522 that is similar in configuration to conductive body 114 of FIGS. 2 and 3A in that it is configured for receiving insulating sleeve 124, compression collar 130 and locking ring 132 for locking fitting 502 into position within drill pipe opening 102*a*. An inner conductive member 524 is supported within outer conductive member 522 by an electrically insulating sleeve member 526. The latter extends into drill pipe through hole 102*a* beyond member 524 in order to reduce the drilling fluid ground path and defines a lip 526 abutting the inward edge of inner conductive member 524 which serves to prevent lateral movement of the inner conductive member into through hole 102*a*. Inner conductive member 524 may be affixed within insulating sleeve member 526 to avoid lateral movement in an opposing direction, for example, by using structural bonding or interference fitting. Insulating sleeve member 526 further defines a notch 528 which cooperates with outer conductive member 522 to prevent relative movement therebetween. Additional components of fitting 504 include a cylindrical spring 530 and a contact ring 532 which are received within a slot 533 defined between insulating sleeve member 526 and outer conductive member 522 such that contact ring 532 is biased in the direction indicated by an arrow 534. A base loop 535 of spring 530 is attached to outer conductive member 522, for example, by spot welding (not shown) to maintain an electrical connection therebetween. Spot welding may, in turn, be used to attach spring 530 to contact ring 532. When adjacent drill pipe sections are mated, as illustrated, contact ring 532 is resiliently biased against outer conductive body 506 to maintain outer path electrical connection between adjacent drill pipe sections. In an alternative single conductor arrangement, it should be appreciated that the outer path configuration (i.e., using contact ring 532, spring 530 and associated components) may advantageously be utilized in implementing a single, isolated electrically conductive path between the boring tool and drill rig.

Assembly of multi-conductor box end fitting may be performed by first installing spring 530 and contact ring 532 within outer conductive member 522 and performing appropriate spot welding. Insulating sleeve 526 may then be snapped into place using notch 528 as inner conductive member 524 is inserted into and glued within sleeve 526. Sleeve 124, compression collar 130 and locking ring 132 may then be installed about the periphery of outer conductive member 522 followed by bellows 308.

Operation of arrangement 500 is essentially identical to that of previously described arrangements 100 and 300 with regard to the inner conductive path. That is, contact fingers 144 engage the inner surface of inner conductive member 524 as adjacent drill pipe sections are mated. Therefore, advantages attendant to protection of the inner conductive path components during drill pipe handling and connection are equally applicable. Components which make up the outer conductive path enjoy similar protection. Specifically, the configuration used in the outer conductive path, like that of the inner conductive path, serves to protect its components while the drill pipe sections are handled and brought into alignment. As adjacent drill pipe sections are mated, contact ring 532 engages outer path conductive body 506 to form an electrical contact therewith only after the adjacent drill pipe sections are threaded together in substantial alignment. Thereafter, electrical contact is maintained by spring 530 urging contact ring 532 toward outer path conductive body 506 such that the outer paths of adjacent drill pipe sections are automatically electrically connected as the drill pipe sections are mated. Considering the overall configuration of arrangement 500, it should be appreciated that this arrangement is devoid of points at which accumulation of drilling fluid, once dried out, will affect subsequent electrical connections from being reliably formed between both the inner and outer conductive paths of adjacent drill pipe sections.

As discussed previously, a single isolated conductive path may, at once, serve in the transfer of data and for supplying power. In this regard, it should be appreciated that the dual conductive path configuration of arrangement 500 is useful for operation in a "fail-safe" mode in which, for example, the system may automatically switch from a conductive path which fails or exhibits instability to the other conductive path. Other applications of a multiple conductor configuration include, for example, providing signals and power to multiple electronic modules and increasing signal bandwidth by separating signal and power path.

In other multiple conductive path arrangements (not shown), a first adapter fitting may be designed to engage electrical contact surfaces of a second adapter fitting as the first and second adapters are engaged when adjacent drill pipe sections are attached to one another. The contact surfaces may be formed on an inner surface of the first adapter within a through opening defined for the passage of drilling fluid. When adjacent drill pipe sections are connected, the contact arrangement of a second adapter fitting may extend into the first adapter to form an electrical connection with each contact surface. The contact surfaces may be arranged in electrically isolated and side by side in a segmented manner cooperating to circumferentially surround the through opening in the first adapter. Alternatively, the contact surfaces may be arranged in an electrically isolated manner as coaxial rings such that each contact surface extends around the inner surface of the through opening in the first adapter.

With regard to production of drill pipe sections in accordance with the present invention that are configured for automatically maintaining an electrically isolated electrical pathway between the boring tool and drill rig, it should be appreciated that drill pipe sections may be modified during or after manufacture in a number of different ways (not shown) in order to accommodate adapter fittings designed to cooperate with these modifications and manufactured in accordance with the present invention. For example, the through hole of drill pipe sections may be threaded immediately adjacent each end of the drill pipe section. In this way, adapter fittings may be configured with a mating thread such that the adapter fittings may be installed by simple threadable engagement in the through openings of drill pipe sections. As another example, each end of the drill pipe opening may include a diameter that is enlarged relative to the remainder of the through opening extending between the ends of the drill pipe section so as to define a peripheral shoulder surrounding the entrance to the overall reduced diameter remainder of the through opening. Adapter fittings manufactured in accordance with the present invention may be positioned in the enlarged diameter opening at each end of the drill pipe section received against the peripheral shoulder. When adjacent drill pipe sections are attached with one another, adapter fittings therein are "trapped" between the peripheral shoulders of the respective drill pipe sections. Such adapter fittings may be retained in the enlarged diameter using, for example, a suitable adhesive. Moreover, these adapter fittings, as is the case with all arrangements disclosed herein, may include arrangements for reducing the drilling fluid ground path such as an insulating sleeve on each fitting wherein the insulating sleeves of mated adapter fittings engage one another in a resilient manner (see, for example, insulating tube 222, FIG. 7 and bellows 308, FIG. 10).

Figure 13:
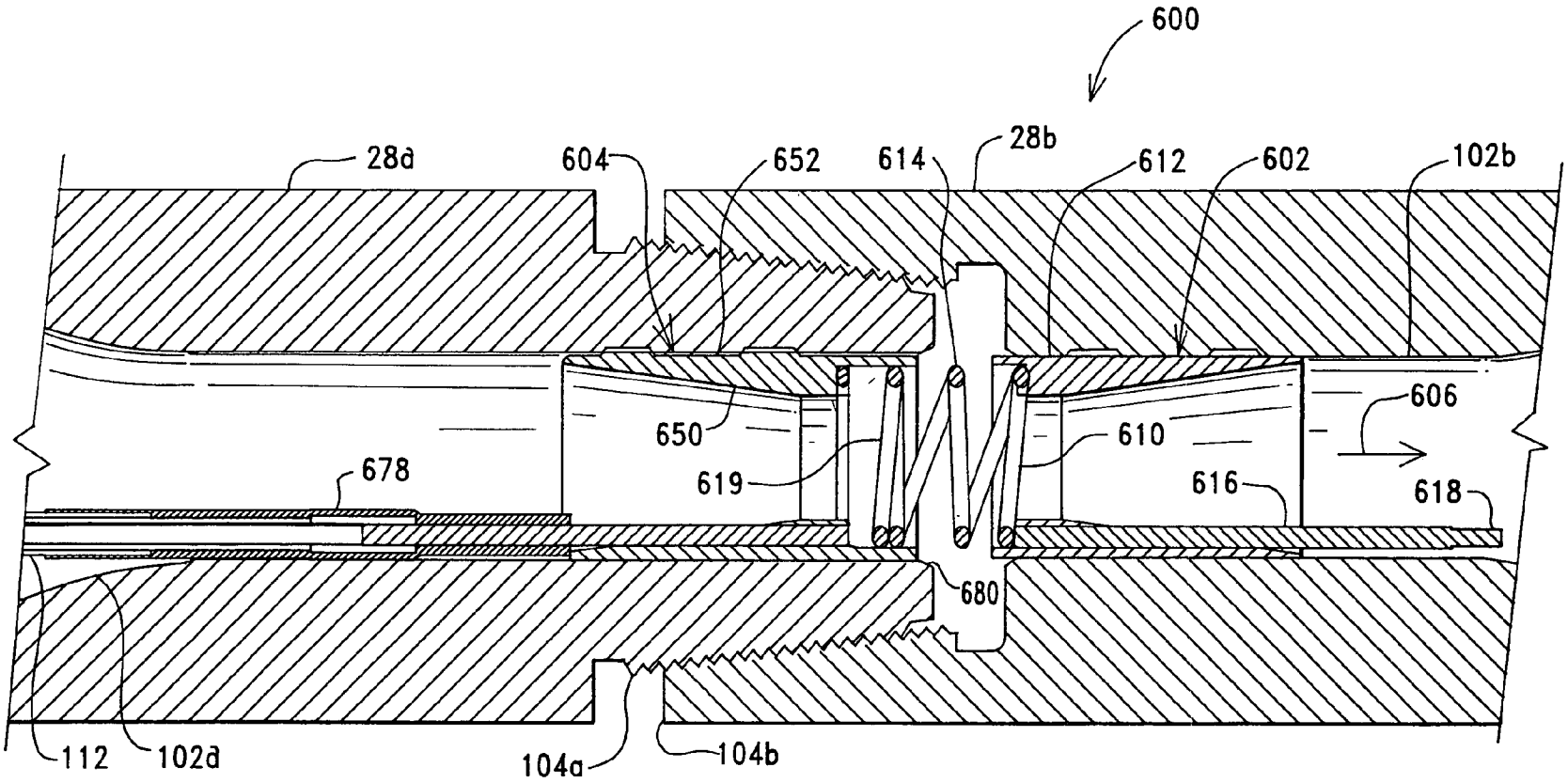
FIG. 13 is a diagrammatic cross sectional view of another embodiment of the present invention for providing an electrically isolated conductor within a drill string including first and second adapters shown here representatively installed in adjacent ends of two drill pipe sections which make up a portion of the overall drill string, the drill pipe sections and adapters are illustrated only partially engaged.

FIG. 13 illustrates another embodiment of an arrangement manufactured in accordance with the present invention and generally indicated by reference numeral 600 for automatically extending and retracting electrically isolated conductors provided in a segmented drill string. As in previously described embodiments, arrangement 600 is configured for use with standard drill pipe sections such as drill pipe section 28. FIG. 13 illustrates drill pipe sections 28*a* and 28*b* having arrangement 600 installed therein and with the adjacent drill pipe sections partially mated and, therefore, in at least partial alignment. As is the case with aforedescribed embodiments, arrangement 600 may be provided as an after market kit for installation in commercially available drill pipe sections which may already be in service or for installation in new drill pipe sections.

Arrangement 600 includes a first adapter fitting 602 which preferably is positioned in through hole 102*b* of drill pipe section 28*b* and a second adapter fitting 604 which preferably is positioned in through hole 102*a* of drill pipe section 28*a*. Drilling mud will typically travel in a direction indicated by an arrow 606 through the innermost passage defined by the drill pipe sections, although the present invention allows for bi-directional flow. Each drill pipe section in an overall drill string (not shown) receives first adapter fitting 602 in its box end fitting 104*b* and second adapter fitting 604 in its pin end fitting 104*a*.

Figure 15:
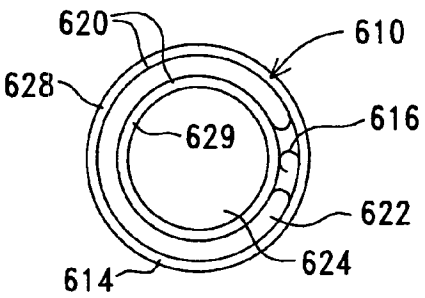
FIG. 15 is a diagrammatic end view of the first electrically conductive member of FIG. 14 taken from a line 15—15 and shown here to further illustrate details of its structure.
Figure 14:
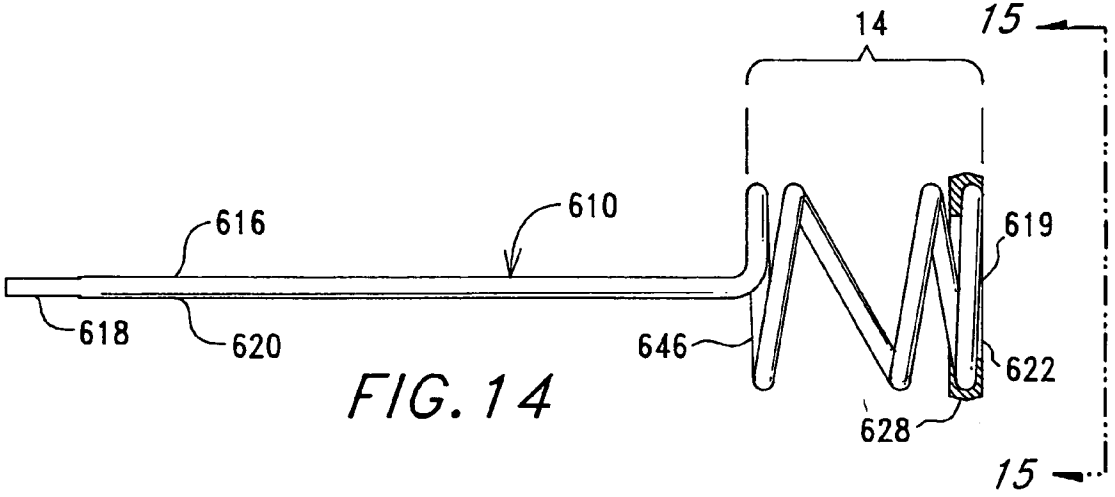
FIG. 14 is diagrammatic plan view of a first electrically conductive member forming part of the first adapter shown in FIG. 13, shown here to illustrate details of the construction of the first electrically conductive member in accordance with the present invention.

Referring to FIG. 14 in conjunction with FIG. 13, first adapter 602 includes a first conductive member 610 supported by a first insulative sleeve 612. As best seen in FIG. 14, first conductive member 610 includes a resilient section 614 and an arm 616 having a distal or electrical connection end 618. A free end 619 opposes distal end 618. In forming the conductive member, a suitable electrically conductive resilient material is used. Such materials include, but are not limited to high strength copper alloys, such as beryllium copper and phosphor bronze. In the present example, the resilient material from which the first conductive member is formed includes a circular cross-section although other shapes may be employed. The generally illustrated form of the first conductive member may be achieved, for example, by bending the resilient material. A major portion of the exterior of first conductive member is coated with an electrically insulative layer 620. In the present example, a powder coating comprising nylon for medium temperature applications is used to form layer 620. For higher temperature applications, fluoropolymer resins can be used. The layer is removed from (or not applied to) the first conductive member in two areas. Specifically, the layer is not present on electrical connection end 618 and on a first electrical contact area 622 which comprises a forward facing, leading area of resilient section 614. As is best illustrated by FIG. 15, first electrical contact area 622 is generally circular in configuration at least partially surrounding a through opening 624. Resilient section 614 is in the form of a helical compression spring for reasons which will be made apparent. For the moment it is sufficient to note that through opening 624 allows for the passage of drilling mud therethrough when the first adapter is in use. Insulative layer 620 serves to reduce electrical contact between the drilling mud and first electrically conductive member 610 thereby minimizing the potential ground path presented by the electrically conductive drill pipe sections contacting an electrically conductive drilling fluid which is, in turn, in contact with the first electrically conductive member.

Referring to FIGS. 14 and 15, an elastomeric sealing ring 626 is formed onto the free end of resilient section 614 essentially radially surrounding the first coil of the resilient section at its free end. The elastomeric sealing ring may be formed in any suitable manner such as, for example, by molding to fixedly attach the sealing ring to the free end of the resilient section. With regard to the configuration of the elastomeric sealing ring, it should be appreciated that the sealing ring includes an outer radial sealing configuration 628 and an inner radial sealing configuration 629 (shown in FIG. 15) to provide a margin of elastomeric material extending radially both inwardly and outwardly with respect to the cylindrical configuration of resilient section 614. This sealing configuration will be described at an appropriate point below. Care should be taken to ensure that first electrical contact area 622 remains free of any excess elastomeric compound. The material from which the elastomeric sealing ring is formed may include, but is not limited to silicon rubber or Viton®. The purpose of the elastomeric sealing ring will be described at an appropriate point below. It is noted that the sealing ring is not shown in FIG. 13 due to illustrative constraints. That is, the assembly scale of FIG. 13 causes the sealing ring to be sufficiently small as to be indistinguishable from adjacent components.

Turning now to FIGS. 13 and 16–18, first adapter 602 includes first insulative sleeve 612, as mentioned above. The sleeve may be formed in any appropriate manner such as, for example, by machining or injection molding. Any suitable electrically insulative material may be used to form the sleeve including, but not limited to nylon, phenolic, epoxy or other such engineering plastics. Sleeve 612 includes a sidewall 632 defining an interior passage 634. A first opening 636 is defined at one end of the interior passage while a second opening 638 is defined at an opposing end of the interior passage. Exterior wall 632 includes an increasing thickness from the first opening to the second opening so as to cause the first opening to have a diameter that is greater than the diameter of the second opening and providing for a tapered configuration therebetween for reasons which will be explained at an appropriate point hereinafter.

Figure 17:
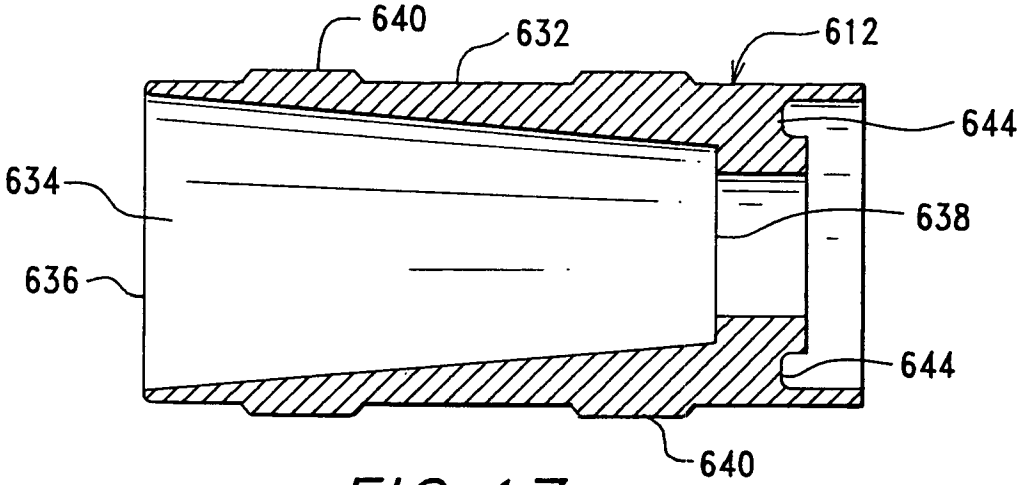
FIG. 17 is a diagrammatic view of the first insulative sleeve of FIG. 16, in cross section, taken along a line 17—17 and shown here to further illustrate details of the structure of the first insulative sleeve including a configuration for supporting a base coil of the first electrically conductive member of FIGS. 14 and 15.
Figure 18:
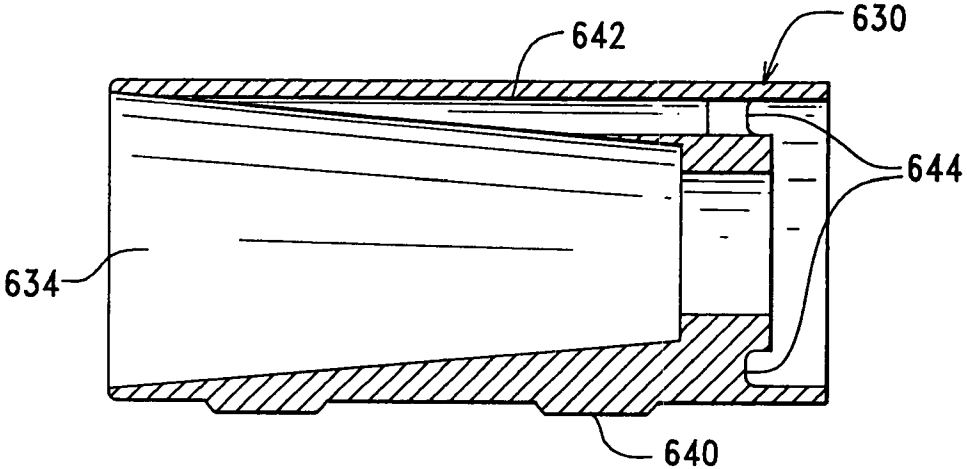
FIG. 18 is a diagrammatic view of the first insulative sleeve of FIG. 16, in cross section, taken along a line 18—18 and shown here to further illustrate details of the structure of the first insulative sleeve including a receiving arm hole for supporting the first electrically conductive member of FIGS. 14 and 15.
Figure 16:
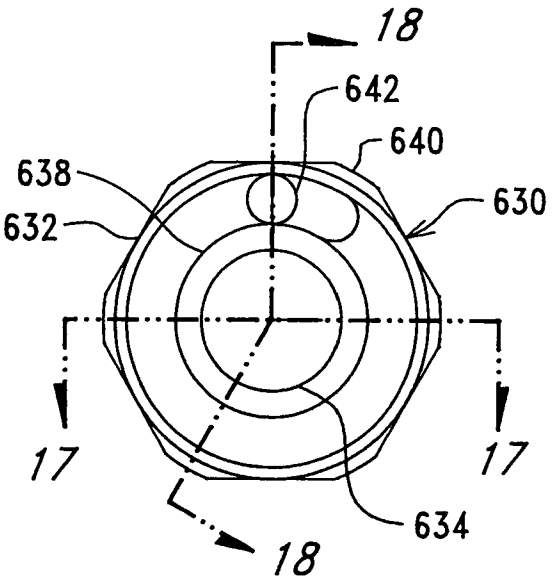
FIG. 16 is a diagrammatic end view of a first electrically insulative sleeve forming a portion of the first adapter as shown in FIG. 13 and configured for supporting the first electrically conductive member of FIGS. 14 and 15.
Figure 22:
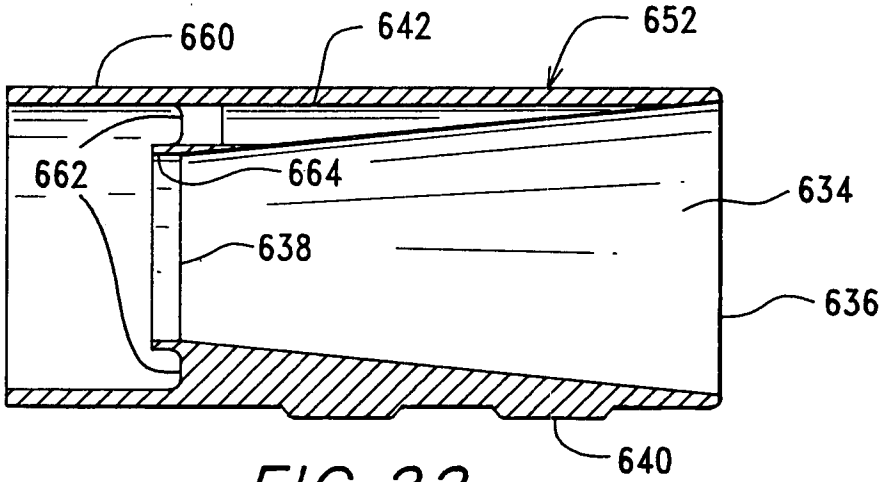
FIG. 22 is a diagrammatic view of the second insulative sleeve of FIG. 21, in cross section, taken along a line 22—22 and shown here to further illustrate details of the structure of the second insulative sleeve including a configuration for supporting a contact coil and arm of the second electrically conductive member of FIGS. 19 and 20.
Figure 23:
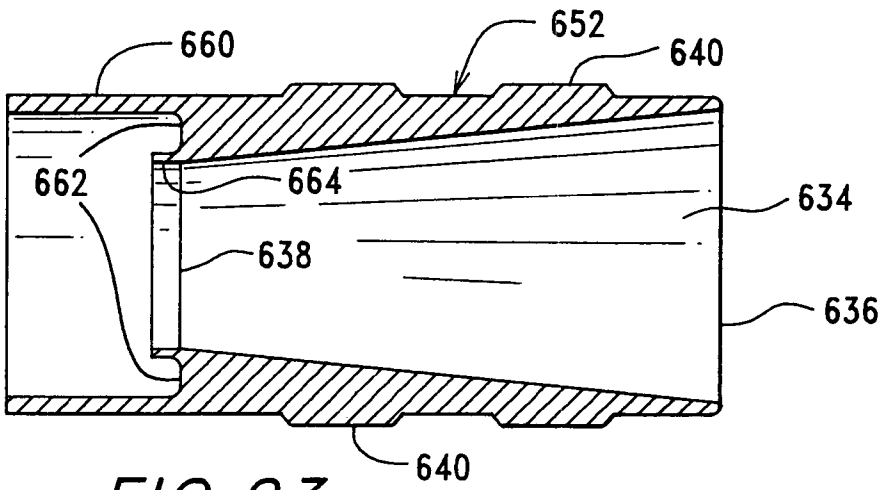
FIG. 23 is a diagrammatic view of the second insulative sleeve of FIG. 21, in cross section, taken along a line 23—23 and shown here to further illustrate details of the structure of the second insulative sleeve of FIGS. 21 and 22.
Figure 21:
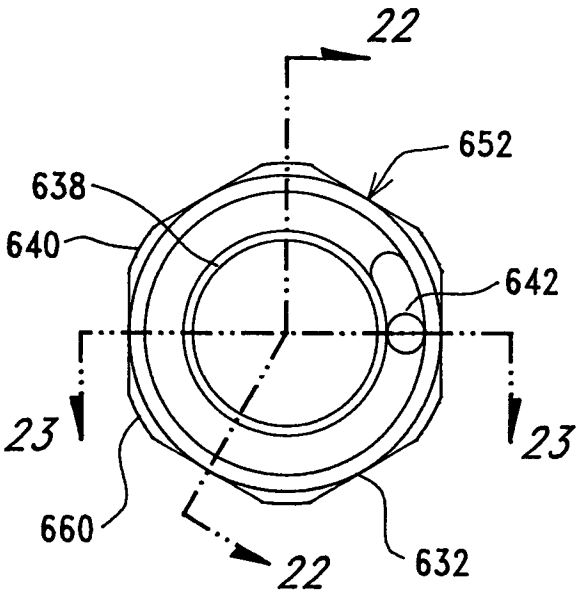
FIG. 21 is a diagrammatic end view of a second electrically insulative sleeve forming a portion of the second adapter as shown in FIG. 13 and configured for supporting the second electrically conductive member of FIGS. 19 and 20.

Continuing with a description of insulative sleeve 612, the sleeve includes an outer surface configuration that provides for an interference fit when inserted into one of the drill pipe sections using at least one interference feature in which a diameter of the insulative sleeve, including the interference feature, is greater than the inner diameter of the innermost passage of the drill pipe section prior to installation in one of the drill pipe sections. In the present example, as illustrated by FIGS. 16–18, the outer surface configuration defines a hexagonal shape thereby forming six interference features indicated by the reference number 640, equi-angularly spaced about the periphery of insulative sleeve 612 (see FIG. 18). In this regard, the material from which the insulative sleeve is formed must be deformable upon being received in the innermost passage of one of the drill pipe sections.

Referring to FIGS. 13, 14, 17 and 18, first insulative sleeve 612 is installed in the innermost passage of drill pipe section 28*b* by initially inserting the end of insulative sleeve 612 proximate to first opening 636 into the innermost passage of the drill pipe section. First conductive member 610 is supported by insulative sleeve 612 utilizing an arm receiving hole 642 that is formed in the sidewall of insulative sleeve 612, as illustrated by FIG. 18. FIG. 13 illustrates arm 616 of first conductive member 610 positioned in arm receiving hole 642. An interference fit may be employed wherein a diameter of the arm receiving hole is sufficiently less than the diameter of arm 616 including insulative coating 620 to provide a snug fit. First conductive member 610 is further supported by a support configuration 644 (see FIGS. 17 and 18) integrally formed in insulative sleeve 612 proximate to and surrounding second opening 638. The support configuration extends at least partially around second passageway opening 638 for receiving a base coil 646 (FIG. 14) of resilient section 614 in a manner which electrically isolates base coil 646 and the rest of the resilient section from the drill pipe section in which it is installed. Support configuration 644 further prevents wear on coating 620 of base coil 646 and is customized to accommodate the specific configuration of base coil 646 thereby providing for stability of the resilient section during operational use to be described.

Referring to FIG. 13, installation of first adapter 602 into the innermost passage of drill pipe section 28*b* is performed such that arm 616 extends inwardly into passage 102*b*, thereby positioning and supporting electrical connection end 618 within passage 102*b*. Resilient section 614 is supported so that free end 619 resides within the cavity defined by box fitting 104*b* of drill pipe section 28*a*. It is to be understood that FIG. 13 shows the drill pipe sections and, therefore, the first and second adapters in an only partially engaged state.

Figure 20:
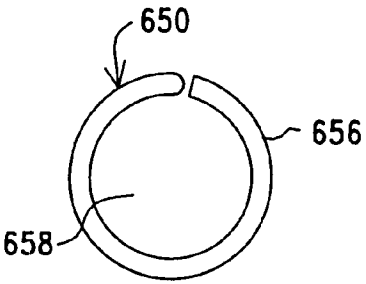
FIG. 20 is a diagrammatic end view of the first electrically conductive member of FIG. 14 taken from a line 20—20 and shown here to further illustrate details of its structure.
Figure 19:
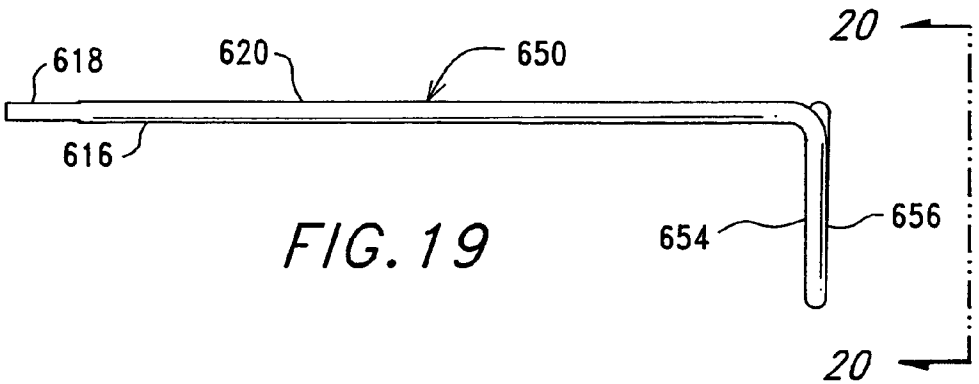
FIG. 19 is diagrammatic plan view of a second electrically conductive member forming part of the second adapter shown in FIG. 13, shown here to illustrate details of the construction of the second electrically conductive member in accordance with the present invention.

Turning now to details regarding second adapter 604, attention is directed to FIGS. 13, 19 and 20. Second adapter 604 includes a second electrically conductive member 650 supported by a second insulative sleeve 652. As best seen in FIG. 19, second conductive member 650 includes a contact section or coil 654 and, like the first conductive member, includes arm 616 having distal or electrical connection end 618. Contact coil 654 defines a generally circular configuration in a plane that is generally transverse to arm 618. The length of arm 616 and the area of electrical connection end 618 may be modified, as needed, in either of the first and second adapters. Generally, the second electrically conductive member may be formed or shaped using the same material and in the same manner as the first electrically conductive member. Insulative coating 620 is applied to the entirety of second conductive member 650 with the exceptions of electrical connection end 618 and a second electrical contact area 656 for the purpose of reducing ground paths through a drilling fluid. The second electrical contact area comprises a forward facing, leading area of contact coil 654. Like the first electrical contact area of the first conductive member, second electrical contact area 656 is generally circular in configuration, at least partially surrounding a through opening 658 for the passage of drilling fluid.

Referring to FIGS. 13 and 21–23, details regarding second insulative sleeve 652 of second adapter 604 will now be provided. Inasmuch as many features of the second insulative sleeve are common to those of first insulative sleeve 612, described above, the present discussion will focus primarily on the ways in which the second insulative sleeve differs from the first insulative sleeve. For instance, second adapter sleeve 652 includes an entrance flange 660 (see FIGS. 13, 22 and 23) for receiving resilient section 614. This flange serves to lessen wear of coating 620 present on the resilient section as well as providing a further degree of electrical isolation between the resilient section and the drill pipe section in which the second adapter is installed. Second adapter 652 further includes a free end receiving configuration 662 for supporting contact coil 654 of the second conductive member and further defining a peripheral sealing lip 664 to be further described.

Turning again to FIG. 13, consistent with the foregoing embodiments of the present invention, the first and second adapters within an individual drill pipe section are in electrical communication with one another via an electrically conductive arrangement that is installed in the innermost passage of the drill pipe section. FIG. 13 illustrates conductive wire 112 bonded to electrical connection end 618 of second adapter 604. A similar connection has not been depicted as being made to electrical connection end 618 of first adapter 602 for illustrative clarity, but will be illustrated in a subsequent figure. Accordingly, insulated wire 112 extends between electrical connection ends 618 of the first and second adapters. Bonding may be accomplished in any suitable manner, for instance, by compression crimping.

During installation, the conductive wire is initially threaded through the innermost passage of the drill pipe section and then bonded to the first and second adapters. The bonded area is further covered by an additional insulating layer 678. This latter layer may comprise, for example, heat shrink tubing or using epoxy to form a bond between the head shrink tubing and the insulating layer so as to further limit ground paths through the drilling fluid. The adapters are then installed in the innermost passage, as shown.

Having described first and second adapters 602 and 604 in detail above, operational use of the adapters will now be considered with initial reference taken to FIG. 13. As mentioned previously, free end 619 of first adapter 602 is positioned within box fitting 104*b* of drill pipe section 28*a*. Accordingly, the free end is displaceable at least laterally (i.e., in directions generally transverse to the length of the drill pipe section in which it is installed) with respect to entering innermost passage 102*a* defined within pin fitting 104*a* of drill pipe section 28*a*. The capability of the free end to displace laterally is highly advantageous with respect to accommodating misalignment present between drill pipe sections being attached to one another. Moreover, resilient section 614 of first conductive member 610 allows for longitudinal displacement (i.e., along the length of the drill pipe section) of free end 619 in cooperation with the aforedescribed lateral displacement. By providing for displacement of free end 619 both laterally and longitudinally, Applicants consider that virtually any misalignment scenario encountered when joining two drill pipe sections is accommodated wherein the drill pipe sections are ultimately successfully attached to one another. Furthermore, other features may be incorporated which still further ensure proper entry of the free end into the innermost passage of a pin fitting in an opposing drill pipe section and, thereafter, into second adapter 604 supported therein. Specifically, as seen in FIG. 13, pin fitting 104*a* includes a peripheral bevel 680 surrounding the entrance to innermost passage 102*a* of drill pipe section 104*a*. By making suitable adjustments in the peripheral bevel, substantial misalignment may be accounted for which is greater than any actual misalignment that is anticipated, thereby providing for a high degree of tolerance to misalignment. Misalignment may result from a number of factors including, but not limited to worn drill pipe sections, end fittings that are out of round due to use or manufacturing problems and machine misalignments. As will be further described, lateral displacement of free end 619 of adapter 102 may account for variation in the installation depth of the adapters in adjacent ones of the drill pipe sections and/or such factors including, but not limited to nonstandard and/or deformed drill pipe end fittings. As described above, flange 660 serves to guide the resilient section during engagement, prevent wear of dielectric coating 620 thereon and to further electrically isolate the resilient section from the drill pipe section in which the second adapter is installed. Moreover, flange 660 includes an interior diameter sized to receive resilient section 614 which further maintains free end 619 in position to assure electrical contact with the contact coil of the second adapter.

Figure 24:
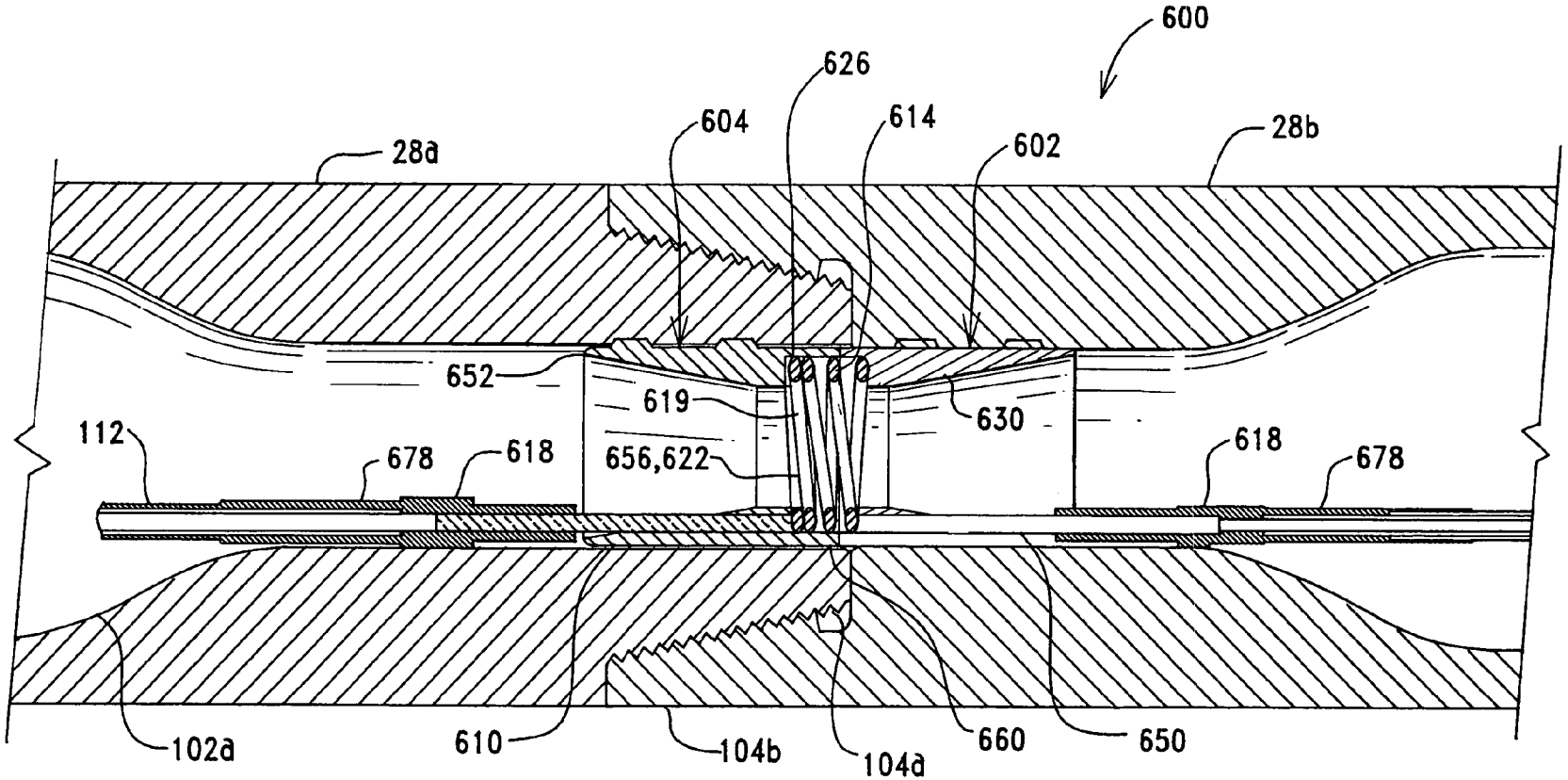
FIG. 24 is a diagrammatic cross sectional view of the embodiment of FIG. 13 of the present invention, shown here to illustrate the first and second adapters of the present invention in a fully engaged state.
Figure 25:
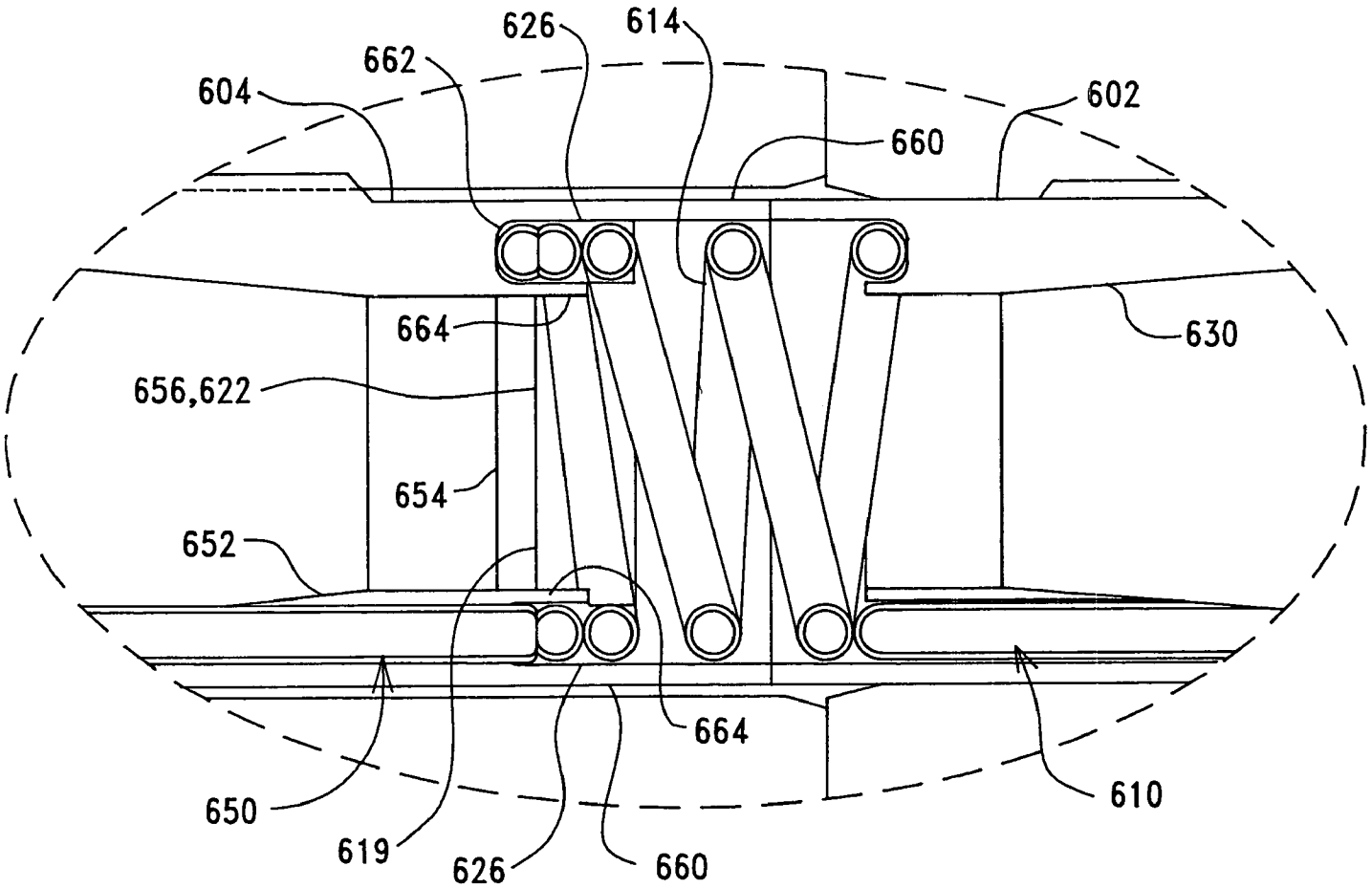
FIG. 25 is an enlarged partial view, in cross-section, of a portion of the assembly of FIG. 24, shown here to illustrate details of the first and second adapters and, in particular, the function of an elastomeric seal forming part of the first adapter.

Referring to FIGS. 24 and 25, drill pipe sections 28*a* and 28*b* are shown in their fully engaged positions. FIG. 24 comprises an assembly level view of mated adjacent ends of a pair of drill pipe sections within a representative drill string. FIG. 25 comprises a partial, enlarged view of a portion of FIG. 24 primarily illustrating resilient section 614 of first adapter 602 engaging second adapter 604. In these illustrations, first and second adapters 602 and 604 have achieved a fully engaged position. As the drill pipe sections are rotated relative to one another, in order to achieve the illustrated state, free end 619 of first adapter 602 engages contact coil 654 of second conductive member 650. During this process, first electrical contact area 622 on the free end of first conductive member 610 in the first adapter physically contacts second electrical contact area 656 on contact coil 654 of the second conductive member in the second adapter. Further engagement of the drill pipe sections, after the point of initial contact of the first and second electrical contact areas, causes the first and second electrical contact areas to be resiliently biased against one another due to compression of resilient section 614 of first conductive member 610. Reliable contact is maintained during operation attributable, at least in part, to maintaining this resilient bias.

Compression of resilient section 614 further permits the first and second electrical contact areas to come into full contact with one another irrespective of misalignment that may be present, for example, between attached drill pipe sections or as a result of installation of one or both of the adapters in a drill pipe section such that the axis of the adapter is out of alignment with the lengthwise axis of the drill pipe section in which it is installed. In other words, the free end of the first adapter is capable of "twisting" in a manner which accommodates virtually any orientation and/or positional variation introduced in a relative sense between the first and second electrical contact areas. This capability to automatically compensate for misalignment is considered as being highly advantageous in and by itself, accommodating misalignment between the axes of the installed first and second adapters which is present for reasons such drill pipe end fitting irregularity and/or improper installation of either or both adapters. It is important to understand that any shape may be utilized for the configuration of the resilient section so long as the desired resilient response is achieved with regard to both mating of adjacent drill pipe sections and resiliently maintaining electrical contact between the first and second electrical contact areas.

Continuing to refer to FIGS. 24 and 25, attention is directed to the function of elastomeric seal 626. As best shown in FIG. 25, when free end 619 of first adapter 602 is received in free end receiving configuration 662 of second sleeve 652, elastomeric seal 626 cooperates with the configuration so as to form a seal between peripheral sealing lip 664 and entrance flange 660. Sealing is at least partially attributable to radial expansion of the elastomeric seal due to compressive forces experienced by resilient section 614. Accordingly, first and second electrical contact areas 622 and 656, respectively, are sealed within a closed region cooperatively defined by second insulative sleeve 652 and elastomeric seal 626. The first and second electrical contact areas are thereby electrically isolated from any materials within the flow bore or innermost passage defined within the drill string. This feature is considered as being highly advantageous, when coupled with cooperating features described above such as coating 620, since the first and second electrically conductive members are both in complete electrical isolation from the flow bore. As a direct result, the present invention may be used with highly conductive fluids such as, for example, including salt or sea water in the flow bore without significant lost of power or high current draw attributable to the high conductivity of the fluid.

Still considering operational use of adapters 602 and 604, as described above, insulative sleeves 630 and 652 include a tapered configuration which serves to diminish any influence on the flow of drilling fluid from the innermost passage of one drill pipe section to the innermost passage of a subsequent drill pipe section. Moreover, the tapered narrowed end of each of the insulative sleeves feeds into through openings 624 and 658 defined by resilient section 614 and contact coil 654, respectively. Through openings 624 and 658 each include a diameter that is at least as large as the diameter of first and second passageway openings 638 (see FIGS. 13, 17 and 22) of the first and second insulative sleeves within the respective adapters. In sum, all of these features cooperate in a way which provides for minimal disturbance and restriction to the flow of drilling fluid.

In yet another application, the present invention is highly advantageous in providing electrical cable connections for tubing in a wellbore for the extraction of hydrocarbons or other substances from or injection into belowground reservoirs. That is, a drill string, configured in accordance with the present invention by being fitted with the described auto-extending and retracting isolated electrical conductor arrangement, may be introduced, for example, into a wellbore for the express purpose of providing an electrical communication path. A dual purpose may be served by such a drill string in being used to itself perform the resource extraction or material injection. Of course, any flowable material may be transferred in this manner. The utility of obtaining knowledge from pressure sensors, temperature sensors and flow meters in such wellbores is already well recognized. It is important in this regard to understand, however, that all such devices may be electrically interfaced using the isolated electrical path provided by a drill string configured in accordance with the present invention. As one among many examples, data from downhole sensors in such wellbores can provide an operator with useful information concerning which valves to adjust to control the ingress of oil, water, or gas into the wellbore. As yet a further example, data obtained from downhole sensors can also permit the operator of a wellbore to commingle different producing zones and control production from multilateral wells in a reservoir, thereby reducing the number of wells required to deplete the reservoir. While such data can be transmitted hydraulically, it is recognized that electrical transmission offers significant advantages, for example by enabling quicker response to commands and allowing an infinite number of control valve positions.

In the prior art, wellbore cable connections may be provided by an electrical cable that is attached to either the casing of the wellbore or supported by or within tubing which is itself within the wellbore. Heretofore, however, the difficulty of making such cable connections, which typically require splices, and the tendency for cable connections, and especially splices, to fail has added significantly to the cost of this technology. The present invention therefore provides heretofore unavailable advantages in this application. Other applications are of course possible, and it should be understood that the transmission or reception of any type of datum that can be carried by a cable external or internal to tubing or pipe can be advantageously facilitated by the present invention. Further, the isolated conductor of the drill string of the present invention may be used as an antenna for the purpose of communicating with wireless in-ground components. In such an embodiment, the in-ground end of the drill string may be positioned sufficiently close to such a component for wireless communication purposes. Moreover, a special antenna arrangement may be used to terminate the in-ground end of the drill string in such an application. Alternatively, the isolated electrical conductor of a drill string configured in accordance with the present invention may provide electrical power, for example, to one or more in-ground devices. Such in-ground devices include, but are not limited to valves, sensors, control/monitoring arrangements, or any other form of in-ground device presently available or yet to be developed which requires electrical power. It is further to be understood that provisions for providing in-ground power and communication may be combined using a multiplexed arrangement even where only one isolated electrical conductor is provided by a drill string, as will be further described immediately hereinafter.

Figure 26:
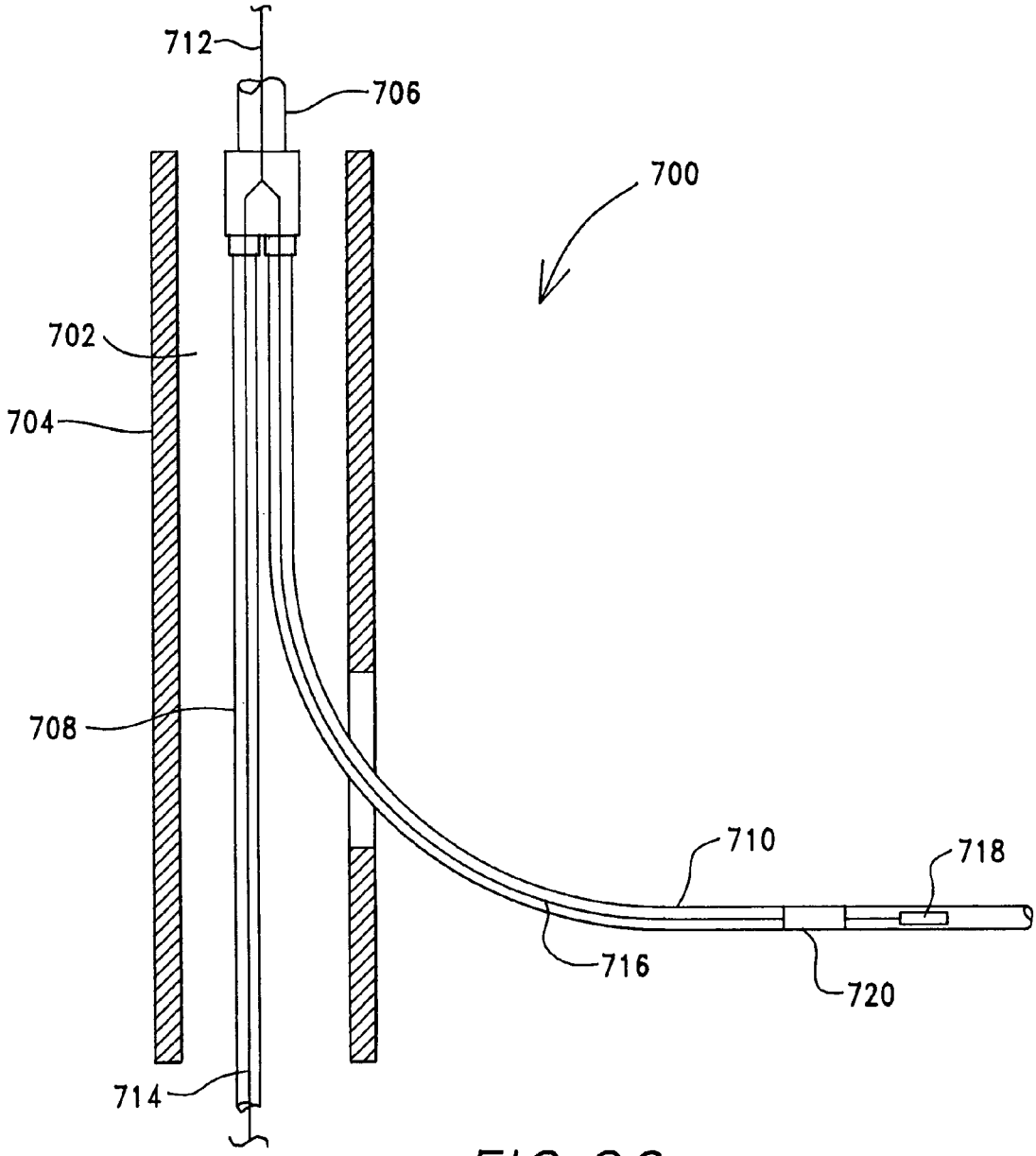
FIG. 26 is a diagrammatic illustration, in elevation, of a portion of a multilateral well having a plurality of drill strings incorporating electrically isolated conductors as taught by the present invention and used to interface a number of in-ground devices for data and/or power transfer.

Attention is now directed to FIG. 26 which illustrates an application within a multilateral oil or gas well, generally illustrated by the reference number 700. Typical components in such an installation may include, for example, multiple valves and data acquisition modules in a radial orientation fanning out from a central wellbore much like the spokes of a bicycle wheel. The present illustration represents a portion of just such a system including a central wellbore 702 defined by a well casing 704. A configuration of drill strings is illustrated including a main branch 706 within central wellbore 704 which leads into first and second sub-branches 708 and 710, respectively, such that the second sub-branch forms a radial spoke. First sub-branch 708 continues down wellbore 704. It is of interest to note that the prior art provides a number of alternative ways in which the illustrated arrangement of drill strings, and still more complex arrangements, may be achieved. The application of the present invention in this context is highly advantageous. Specifically, each section of drill string may be installed through the practice of the present invention such that a continuous electrically isolated conductive path is defined by each section of drill string. These isolated electrical paths are diagrammatically shown as lines and are indicated by the reference numbers 712 for the main branch, 714 for the first sub-branch and 716 for the second sub-branch. At each end of each drill string an electrical connection may be established with a down-hole component. In the present example, second sub-branch 710 includes an instrumentation package 718. Such an instrumentation package may comprise components including, but not limited to processing arrangements, pressure, temperature and flow sensors. Further, an electrically operated valve 720 is provided.

Briefly considering the '332 patent described above, the reader will recall that, in certain applications, rotation of the drill string is not a requirement. In view of the foregoing description of FIG. 26, it is to be understood that the term "drill string", as embraced by this disclosure and the appended claims, is considered to remain apposite irrespective of whether actual drilling and/or rotation of a drill string is required. It is of significance, however, that the present invention provides an isolated electrically conductive path that is essentially immune from damage resulting from typical external physical contact events. Further, a drill string incorporating the present invention may be installed in a wellbore with essentially no special attention required to establish the electrically conductive path; cable splicing and other such prior art activities are not required. Moreover, this automatically established conductive path may be rotated continuously or intermittently and is not subject to external contact damage as are prior art installations which deploy a cable attached, for example, to the exterior of a drill string.

Inasmuch as the present invention enjoys a broad range of applicability, it should be appreciated that the term "drill rig" is considered as any device adapted for positioning or installing a drill string that falls within the scope of the present invention. Consistent therewith, the terms "drill pipe section" and "pipe section" are considered to encompass any sectioned pipe or tubular component configured in accordance with the present invention. The term "drill head" is considered to generally encompass any useful configuration of the in-ground end of the drill string. Of course, the terminating pipe section may support a borehead arrangement that is configured for drilling. In addition or as an alternative, a terminating pipe section or sections may house or support components such as sensors and/or valves or such components may be appropriately positioned proximally to the in-ground end of the drill string, interfaced to the isolated electrically conductive path defined therein. Moreover, such components may be interfaced to the electrically conductive path at one or more intermediate points along the drill string. That is, there is no requirement to position or support interfaced components at or even near the in-ground end of the drill string. An "interfaced component" refers to any component in communication with the electrically conductive path defined by the boring tool for power related purposes (i.e., either providing power to the path or using power obtained therefrom) or for data purposes. Thus, interfaced components may be above and below the surface of the ground. With respect to the term "drilling fluids", the present application contemplates any suitable flowable material that is transferable through the flow bore of the drill string of the present application including materials passing down the drill string from the surface or, oppositely, from the ground to the surface.

While down hole components such as those described with regard to FIG. 26 are not unknown in the prior art, it has been a considerable challenge to effectively, relatively simply and yet reliably electrically interconnect such components. The present invention serves in a highly advantageous way which is thought to resolve this problem. By using only a single electrically conductive path established by the present invention between all of the components, the components may be interfaced using any suitable protocol. For example, component interfacing may be performed using time domain multiplexing or using token ring. Accordingly, individual valves may be controlled from an above ground location or by other in-ground components. In such arrangements, each valve or data acquisition station has its own unique address, or ID, that can be individually addressed from any controller so as to form a highly advantageous network providing for data as well as power transfer. Moreover, down hole controllers may communicate with one or more above ground controllers. Thus, the present invention may serve as the backbone for providing power and signal to down hole valving, sensors and data logging equipment.

Figure 27:
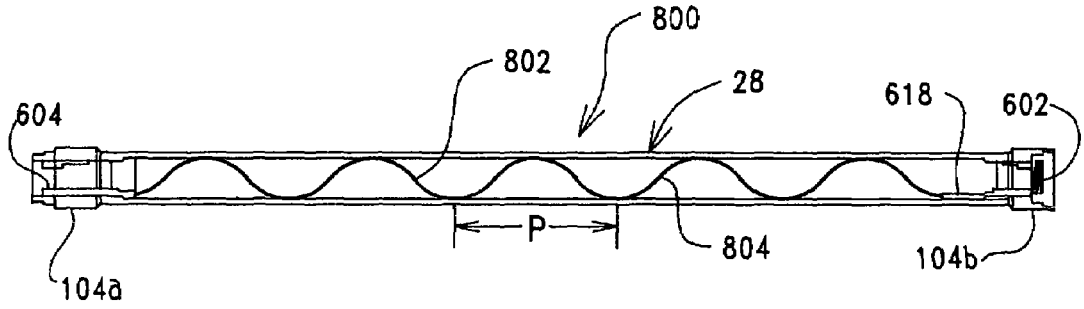
FIG. 27 is a diagrammatic side view of a pipe section shown here to illustrate the installation of a highly advantageous isolated conductor assembly including a helical coil conductor installed in the inner passage of the pipe section in accordance with the present invention.

Referring to FIG. 27, one embodiment of a highly advantageous isolated conductor assembly, produced in accordance with the present invent and generally indicated by the reference number 800, is shown installed in one of pipe sections 28. Assembly 800 includes first adapter fitting 602 installed in box end fitting 104*b* and second adapter fitting 604 installed in pin end fitting 104*a*. It should be appreciated that adapters 602 and 604 are shown within assembly 800 for illustrative purposes only and that any of the highly advantageous adapter pairs described above may be used interchangeably in this assembly.

Figure 28A:
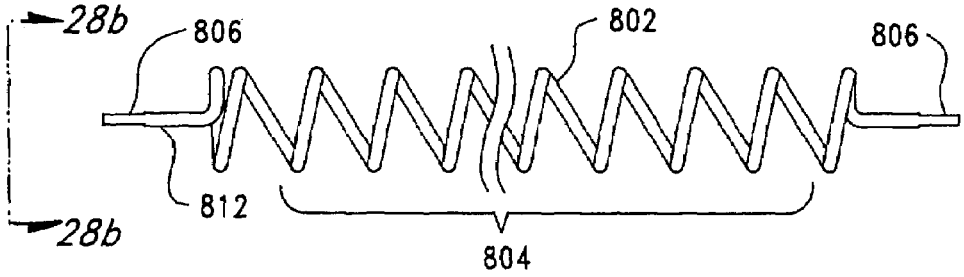
FIG. 28*a* is a diagrammatic side view showing the helical coil conductor of FIG. 27 in a pre-installation, relaxed state.
Figure 28B:
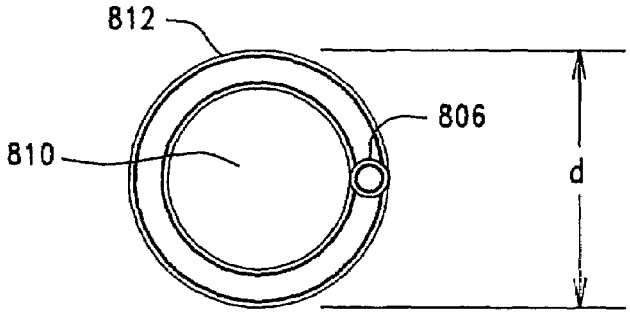
FIG. 28*b* is a diagrammatic end view of the helical coil conductor of FIGS. 27 and 28*a*, in the pre-installation state.

Referring to FIGS. 28*a* and 28*b* in conjunction with FIG. 27, assembly 800 further includes a helical coil spring conductor 802. FIG. 28*a* is a view of the helical coil spring in elevation and in at least a semi-relaxed state prior to installation, while FIG. 28*b* is an end view taken from a line 28*b*-28*b* shown in FIG. 28*a*. Spring conductor 802 includes a cylindrical main portion 804, having an outer diameter d and a pair of opposing connection ends 806. Further, a central opening 810 (FIG. 29) is defined. The entire length of the spring conductor, excepting connection ends 806, is covered with an electrical insulation jacket 812, serving the dual purposes of preventing an electrical short to an electrically conductive pipe section (FIG. 27) and avoiding ground loops through an electrically conductive fluid (not shown) that may be present in the innermost passage of the pipe section. Spring conductor 802 may be formed using any suitable spring material as a base including, but not limited to steel wire, stainless wire and copper alloy. The base material may include any suitable cross-sectional shape such as, for example, circular, ovoid, rectangular and a flat bar configuration having a pair of opposing major surfaces. Moreover, since the base material may be characterized as having relatively high electrical resistance, a cladding may be applied to one or more exterior surfaces of the base wire in any suitable manner such as, for example, by plating. The cladding may comprise any suitable electrically conductive material having a sufficiently high electrical conductivity such as copper. Following application of a cladding layer, the overall spring conductor may receive the application of the insulating jacket. The insulating jacket may be formed from any suitable material including, but not limited to Teflon, silicon rubber, or PVC. Of course, the jacket material may be selected in view of the anticipated environment within the innermost passage of the pipe section considering factors which include temperature and corrosiveness of flowable materials within the innermost passage. As mentioned above, the insulating jacket covers the entirety of the cylindrical main portion of the spring conductor and is not applied or is stripped away from connection ends 806.

Referring to FIGS. 24, 27 and 28*a*, electrical bonding between connection end 806 and each adapter may be accomplished in any suitable manner, for instance, by compression crimping as illustrated in FIG. 24 and described in its associated description. Any other suitable connection method may be employed which provides the requisite durability and resistance to penetration by drilling or other fluids within the pipe section.

Figure 29:
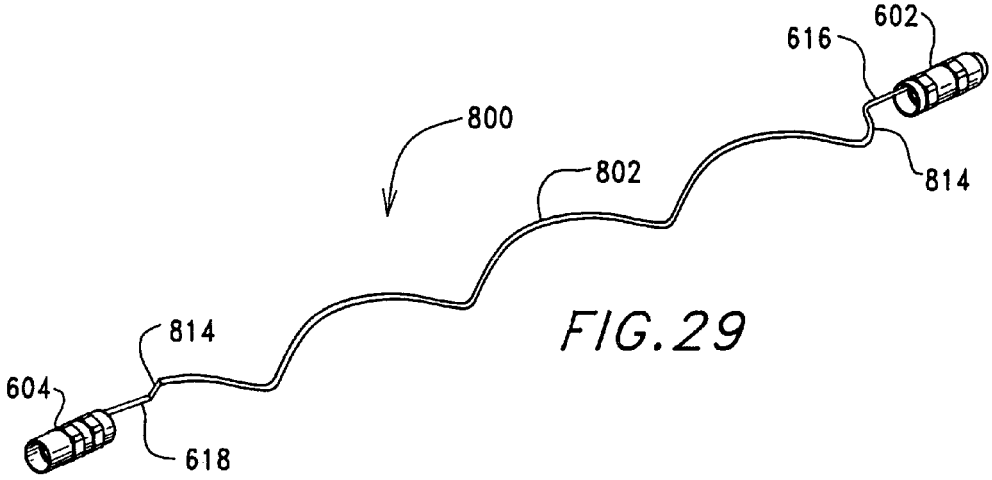
FIG. 29 is a diagrammatic view, in perspective, of the highly advantageous isolated conductor assembly of FIG. 27, showing the assembly as it appears in its installed state, but without showing a pipe section for purposes of illustrative clarity.

Referring to FIGS. 27–29, attention is now directed to specific details of assembly 800. The latter is illustrated in FIG. 29 without the presence of a pipe section for purposes of clarity, but in an installed condition wherein spring conductor 802 is elongated between adapters 602 and 604 at either end of a pipe section. In particular, spring conductor 802 is configured to spiral through innermost passage or through hole 102 of the pipe section in a highly advantageous manner so as to resiliently bias diameter d of cylindrical main portion 804 against the inner wall of pipe section 28. In this regard, main portion 804 is generally configured as a helical coil spring such that diameter d decreases with elongation of the spring conductor. Stated slightly differently, the pitch of the spring, as it is elongated, is related to diameter d in a direct way. The relationship between the pitch of the spring to the diameter of the spring is expressed as:

$$d = \frac{1}{\pi}\left[\frac{Wirelength^2}{\text{number_of_coils}^2} - p^2\right]^{\frac{1}{2}} \tag{1}$$

Where Wirelength is the overall length of the base wire or conductor, number_of_coils is the number of turns in main portion 804 and p is pitch, as show in FIG. 27, corresponding to an elongation length of a single one of the coils. With the wire length and number of coils fixed, the magnitude in the bracket of Equation 1 decreases as the pitch increases. So long as the expression:

$$\text{Wirelength} > [(\text{number_of_coils})*p] \quad (2)$$

is true, Equation 1 is valid and is useful in determining the configuration of spring conductor 802 in both its relaxed state and its installed condition. Accordingly, with the wire length and number of coils fixed, the magnitude in the bracket of Equation 1 decreases as the pitch increases.

In the installed condition shown in FIGS. 27 and 29, main coil portion 804 of spring conductor 802 applies a resilient bias outwardly against the inner wall of a pipe section. The amount of bias that is applied should be sufficient to hold the main coil portion against the inner wall during normal operational conditions. The magnitude of the bias force is controlled by factors that include installed pitch, characteristics of the base material used for the spring coil including its material properties as well as its physical dimensions and the pipe's internal dimension. Suitable results have been obtained with a relaxed diameter in the range of approximately 20–50% more than the diameter of the inner passage of the pipe section. With regard to the configuration of spring conductor 802, it should be appreciated that resilient, main portion 804 is not limited to a cylindrical configuration and that any suitable configuration may be utilized. For example, each coil may be formed having any number of "flats" or straight segments with bends therebetween so as to define a geometric shape in an end view (such as a hexagon). In such a configuration, the bend regions engage the inner wall of the pipe section.

Referring briefly to FIG. 24 along with FIGS. 27 and 29, with regard to installation of spring conductor 802, it should be appreciated that the pipe section at each end includes an entrance configuration having a restricted diameter relative to the diameter of the inner passage. Accordingly, in one manner of installation, the spring conductor may be "threaded" into the inner passage through the restricted diameter entrance opening. That is, the spring conductor may be partially elongated as it engages the entrance opening of a pipe section. The pipe section and spring conductor are then rotated relative to one another to thread the spring conductor into the inner passage beyond the restricted diameter entrance opening. During this process, the end of the spring conductor entering the inner passage may be pulled from the opposing end of the pipe section to continue elongation of the spring conductor throughout the longitudinal extents of the inner passage. A first one of adapters 602 or 604 may be pre-connected to the free end of spring conductor 602 and then pressed into its associated entrance opening. The other, second adapter is connected to the opposing end of spring conductor 602 following installation of the spring conductor in the inner passage by pulling the free end of the spring conductor out of the pipe section by an amount that a sufficient to permit connection of the second adapter to the free end. The second adapter is then pressed into its associated entrance opening of the pipe section. During this process, the second adapter may be moved slightly from side to side in order to assist the natural tendency of the spring conductor to pull back into the innermost passage of the pipe section. Electrical connection or bonding of the spring conductor to connection ends 618 of the adapters may be accomplished using a flexible bonding lead 814 that is electrically bonded at either end to connection ends 806 of the spring conductor and 618 of the adapter. These connections may be compressively formed, for example, as shown in FIG. 24 and described with reference thereto.

Referring to FIG. 27, in the instance of most pipe section configurations, the restricted diameter entrance opening at either end of the pipe sections is generally inconsequential insofar as installation of the spring conductor is concerned. This is particularly true in the case of larger diameter drill strings such as used, for example, in the field of underground resource extraction. Accordingly, in another manner of installation, a fish tape (not shown) or some other appropriate pulling arrangement is passed through the inner passage of a pipe section. A first one of adapters 602 or 604 is connected to one end of spring conductor 802. The opposing, free end of the spring conductor is connected to the fish tape. Using the latter, spring conductor 802 is pulled through the inner passage of the pipe section sufficient to permit installing the first one of the adapters. The opposing end of the spring conductor is pulled out of the opposite end of the pipe section inner passage for electrical bonding with the second adapter in a suitable manner such as using a crimp connection, as described above. The second adapter is then manipulated so as to reposition the spring conductor back into the inner passage of the pipe section, for example, using the resilient force applied by the spring conductor itself. The second adapter is then installed in its associated end opening.

Having described one embodiment of the isolated conductor assembly of the present invention, it is now appropriate to discuss its advantages. Initially, it is noted with reference to FIG. 28*b* that diameter d is typically proportionally reduced as a result of elongation of the spring conductor in its installed condition. This diameter reduction, however, leaves central opening 810 at a diameter that is typically larger than the opening diameters formed at the restricted entrance opening at either end of the pipe section (see FIG. 27). Accordingly, a centered, unrestricted passage is defined throughout the length of a drill string having assembly 800 installed in each pipe section, while providing an electrically isolated conductive path through the drill string. The centered passage is highly advantageous in providing the ability to route an elongated member such as a tool therethrough. The use of such down-hole tools is seen particularly in the application of drill strings employed in underground resource extraction including oil and natural gas drilling where pipe sections typically include relatively large inner passage diameters, for example, on the order of 4 inches. The spring conductor of the present invention is highly advantageous by incorporating an active bias configuration which continuously, resiliently self-biases the conductive path defined by the spring member against the inner wall of each pipe section. In this way, the spring conductor returns to its desired position against the inner wall, even if it is temporarily disturbed by a down-hole tool.

Should the spring conductor be damaged in a pipe section, it is readily replaceable along with it associated adapters. Assembly 800 may be provided for installation in pipe sections that are already in use or may be pre-installed in pipe sections at the time of manufacture. In either case, the cost of the upgraded drill string is considered as modest in view of the advantages that are afforded.

Figure 30:
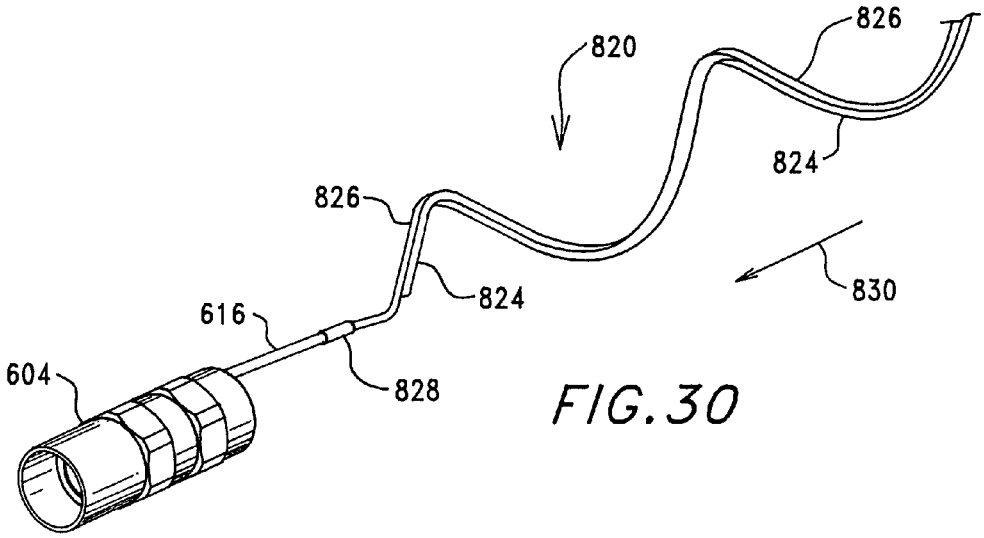
FIG. 30 is a diagrammatic view, in perspective, showing an alternative embodiment of the isolated conductor assembly of the present invention incorporating a conductor that is separate from a helical coil spring.

Attention is now directed to FIG. 30 which illustrates an alternative, second embodiment of an isolated conductor assembly produced in accordance with the present invention and generally indicated by the reference number 820. It is noted that, like first embodiment 800, second embodiment 820 uses adapters 602 and 604 (only the latter is shown) for purposes described above. In this regard, the reader is referred to the foregoing discussions of the first embodiment for additional details. It is to be understood that the second embodiment of the isolated conductor arrangement shares the advantages described above with regard to the first embodiment, unless otherwise noted. Moreover, material properties, installation processes and operational characteristics are further shared.

Considering second assembly 820, FIG. 30 illustrates one end of assembly 820 including adapter 604. The illustrated portion of the assembly is shown as it appears in an installed condition within a pipe section, but without showing the latter for illustrative clarity. Assembly 820 differs from assembly 800 in its use of a spring conductor arrangement 822 which is itself made up of two components including an elongatable spring 824 and an elongated electrical conductor or cable 826. Elongatable spring 824 may be formed from any suitable spring material and, like spring conductor 802, described above, may include any suitable cross sectional shape. Moreover, a cylindrical main body configuration is not required. That is, other suitable shapes which employ straight segments having bends therebetween may be utilized. Unlike spring conductor 802 of the first isolated conductor assembly, however, electrical conductivity properties with respect to spring 824 are not of particular concern since it is not used for the purpose of electrical conduction. Electrical properties of concern, however, are exhibited by conductor 826. Certain properties of the electrical conductor may therefore be selected in a way which produces a minimal impact upon the spring-like properties of spring 824. For example, electrical conductor 826 may comprise a stranded copper cable including a sufficiently fine number of strands to provide for a relatively high degree of flexibility while exhibiting a high electrical conductivity. At the same time, electrical conductor 826 includes an outermost insulating jacket that is selected both for its durability, resistance to fluids within the drill string and its flexibility characteristics. Suitable jacket thing materials are described above with respect to the first embodiment of isolated electrical conductor assembly.

Figure 31:
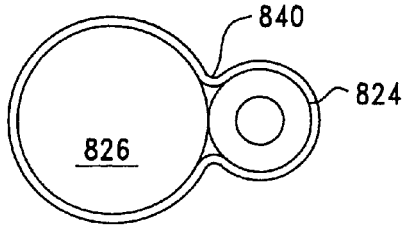
FIG. 31 is a diagrammatic end view of a spring member supported against an insulated electrical conductor using heat shrink tubing.

Referring to FIG. 31, electrical conductor 826 and spring 824, shown in an end view, can be held together, for example, by heat shrink tubing 840, as applied prior to installation of assembly 820 into a pipe section. As another alternative, described above, spring 824 with a suitable electrical insulator jacket, such as heat shrink tubing 840 or any other suitable material, can itself be used as electrical conductor.

Referring again to FIG. 30, electrical cable 826 is arranged to extend beyond the end of spring 824 sufficient to facilitate forming electrical bonds to the free ends of the cable. As is the case in the installation of first embodiment 800, the first one of adapters 602 or 604 is initially electrically bonded to one end of electrical cable 826, for example, by a compression crimp connection 828, as is described above with regard to FIG. 24. The combination of spring 824 and 826 is then pulled from its unconnected end through the inner passage of a pipe section. At least the free end of electrical conductor 826 is pulled out of the opposing end of the pipe section inner passage for purposes of electrical bonding to connection end 618 of the second one of adapters 602 or 604. The second adapter is then installed in the inner passage of the pipe section.

As mentioned, the second embodiment of the isolated conductor assembly shares the advantages provided by the first embodiment. Additionally, still further advantages may be provided. For example, with reference to FIG. 30, spring 824 may be arranged side by side with cable 826 in a way which is intended to protect the latter. That is, with respect to a down hole direction indicated by an arrow 830, spring 824 is arranged ahead of electrical cable 826 such that a tool traveling down the drill string tends to contact only spring 824. In this regard, it should be appreciated that retraction of the tool is less likely to damage the electrical cable since the tool is relatively self-centering by virtue of having already passed down the drill string.

It is to be understood that one or more drill strings incorporating isolated conductor assembly 800 or 820 in each pipe section may readily be installed in pre-existing wellbores for the purpose of providing an electrically conductive path. The latter may provide communications capabilities and/or electrical power to down-hole components. The wellbore may comprise a single well or form a portion of a multilateral system, as described with regard to FIG. 26.

Inasmuch as the arrangements and associated methods disclosed herein may be provided in a variety of different configurations and modified in an unlimited number of different ways, it should be understood that the present invention may be embodied in many other specific forms without departing from the spirit of scope of the invention. Therefore, the present examples and methods are to be considered as illustrative and not restrictive, and the invention is not to be limited to the details given herein, but may be modified within the scope of the appended claims.

What is claimed is:

1. In a system including a drill string having a length which is configured for extension and/or retraction, said drill string being made up of a plurality of pipe sections having opposing first and second ends and a section length having an inner wall defining an innermost passage and all of which pipe sections are configured for removable attachment with one another by physically connecting the first end of one pipe section with the second end of another pipe section to facilitate extension of the drill string by at least one section length at a time, an assembly for use with each one of the pipe sections, said assembly comprising:

an electrical contacting arrangement for forming an isolated electrical connection between attached ones of the pipe sections and located within the innermost passage at each opposing end of each pipe section; and an electrical conductor located in the innermost passage of each pipe section and in electrical communication with said electrical contacting arrangement at each opposing end of each pipe section to extend therebetween in a way which provides an electrically conductive path that is arranged against the inner wall of the innermost passage of each pipe section and which electrically conductive path cooperates with the electrical contacting arrangement to form an overall electrically isolated conductive path through the drill string.

2. The assembly of claim 1 wherein said electrical contacting arrangement includes a pair of adapters for installation of a first one of the adapters in a first end of the innermost passage of each one of said pipe sections and installation of a second one of the adapters in a second end of the innermost passage of each one of the pipe sections, said first and second adapters being configured for establishing said isolated electrical connection between attached ones of the pipe sections.

3. The assembly of claim 1 wherein the electrical conductor is resiliently biased against the inner wall.

4. The assembly of claim 3 wherein said electrically conductive path at least generally forms a helix that is biased against the inner wall and said helix having opposing helix ends that are electrically attached to the electrical contacting arrangement at opposing ends of each pipe section.

5. The assembly of claim 1 wherein said electrical conductor is a coil spring having a coiled length that is extended along the innermost passage of each pipe section and having opposing spring ends that are electrically attached to the electrical contacting arrangement at the opposing ends of each pipe section and said coiled length is configured to resiliently bias against the inner wall of the innermost passage.

6. The assembly of claim 5 wherein said innermost passage includes a passage diameter and wherein said coiled length, prior to insertion into the innermost passage, includes an outer diameter that is greater than the passage diameter of the innermost passage.

7. The assembly of claim 6 wherein said coiled length includes a cylindrical outline defining said outer diameter.

8. The assembly of claim 5 wherein said coil spring is a helical coil spring.

9. The assembly of claim 5 wherein said coil spring includes an outermost electrical insulating layer.

10. The assembly of claim 5 wherein said coil spring includes a base wire, having an electrical resistance, coated with a lower resistance layer.

11. The assembly of claim 10 wherein said lower resistance layer is a copper cladding.

12. The assembly of claim 11 including an electrically insulating jacket covering said copper cladding.

13. The assembly of claim 5 wherein said coil spring includes a base wire that is generally circular in cross-section.

14. The assembly of claim 5 wherein said coil spring includes a base wire that is generally rectangular in cross-section.

15. The assembly of claim 5 wherein said coil spring includes a base wire having a pair of opposing major surfaces.

16. The assembly of claim 1 wherein the electrical conductor is electrically insulated extending between the electrical contacting arrangement at opposing ends of each pipe section and said assembly includes a support arrangement which supports the insulated electrical conductor proximate to the inner wall.

17. The assembly of claim 16 wherein the support arrangement is configured for resiliently supporting the electrical conductor proximate to the inner wall.

18. The assembly of claim 17 wherein the support arrangement includes a helical coil spring for supporting the electrical conductor along a helical path proximate to the inner wall.

* * * * *